US006039435A

United States Patent [19]

Wakahara

[11] Patent Number: 6,039,435

[45] **Date of Patent: *Mar. 21, 2000**

[54] IMAGE FORMING APPARATUS WITH RESTRUCTURED IMAGE DATA

[75] Inventor: Shirou Wakahara, Chiba, Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/145,004

[22] Filed: Sep. 1, 1998

[30] Foreign Application Priority Data

Sep. 9, 1997 [JP] Japan ..... 9-244329

[51] Int. Cl.[7] ..... B41J 2/04

[52] U.S. Cl. ..... 347/55

[58] Field of Search ..... 347/55, 120, 123, 347/111, 151, 128, 127, 154, 103, 85, 84, 100; 399/271, 290, 292, 293, 294, 295

[56] References Cited

U.S. PATENT DOCUMENTS 5,708,464 1/1998 Desie ..... 347/55

FOREIGN PATENT DOCUMENTS 6-246956 9/1994 Japan .
6-344588 12/1994 Japan .
6-091918 4/1995 Japan .
7-089117 4/1995 Japan .

OTHER PUBLICATIONS

TonerJet. Array Printers Ab 1990 disclosure.

*Primary Examiner*—John Barlow
*Assistant Examiner*—Raquel Yvette Gordon
*Attorney, Agent, or Firm*—David G. Conlin; Richard E. Gamache

[57] ABSTRACT

An image forming unit having a toner supplying section and a printing section, causes the toner supported on a toner support to jump and pass through gates so that the toner adheres to the paper being conveyed from the paper cassette, thus forming an image directly on the paper. In this arrangement, when the value as to a certain image-quality indicator for the image which is to be formed, differs from the value for the image which is a predicated, actually formed image, by the predetermined amount, the image data is restructured so that the desired image can be obtained.

11 Claims, 27 Drawing Sheets

Image forming control unit configuration

Flowchart when the operation is started

IMAGE FORMING APPARATUS WITH RESTRUCTURED IMAGE DATA

BACKGROUND OF THE INVENTION (1) Field of the Invention

The present invention relates to an image forming apparatus which forms images on the recording medium by causing the developer to jump thereto and can be applied to a printer unit in digital copiers and facsimile machines as well as to digital printers, plotters, etc.

(2) Description of the Prior Art

In recent years, image forming means for producing a visual image on recording medium such as paper etc., in response to an image signal have been known and developed. For example, Japanese Patent Application Laid-Open Hei 6 No. 246,956 discloses an image forming apparatus in which control electrodes for controlling the passage of toner are provided in the toner flow control unit, and the areas of the control electrodes are made greater from the upstream side toward the downstream side with respect to the moving direction of the toner support, whereby high quality images are formed at high speed.

Japanese Patent Application Laid-Open Hei 6 No. 344, 588 discloses an image forming apparatus in which the electric field control means is configured so that a lower control voltage than that applied to the control portion located on the downstream side, with respect to the direction in which the toner support is supplying the toner, is applied to the control portion located on the upstream side, so as to enhance the printing density and thereby produce high quality images.

Japanese Patent Application Laid-Open Hei 6 No.91,918 discloses an image forming apparatus in which the voltage applied to each of toner inflow-side electrodes or the voltage application time thereto are varied in accordance with the distance from the toner inflow-side electrode to the toner supplying roller, to thereby reproduce an image with the predetermined density on the recording paper.

Further, Japanese Patent Application Laid-Open Hei 7 No. 89,117 discloses an image forming apparatus in which the control voltage applied to the control portion located on the downstream side with respect to the supplying direction of charged particles is altered in accordance with the controlled state of the control portion located on the upstream side, so as to enhance the printing density and thereby produce high quality images.

In all of the above prior art, charged particles are placed in an electric field so that they will jump by electric force whilst the potential being applied to the control electrode, having a number of passage holes and located in the jump path, is being varied, to thereby make the charged particles adhere to the recording medium, thus forming a visual image on the recording medium, directly. In image forming apparatuses of this type, the jumping of toner is controlled so as to form images. Illustratively, a control means for controlling passage of the charged particles through gates is used to control the electric field formed between the gates and the toner support, and whilst the jumping of toner is controlled, the toner is made to reach to the paper surface by a strong electric field generated by the opposing electrode.

These prior art image forming apparatus, however, suffer from a problem in that the shape and density of formed dots are not uniform resulting in image degradation, for example, producing difficulties in effecting exact reproduction of a halftone dot image. More specifically, in these conventional configurations, when the area on the toner support from which toner jumps is greater than that of the gate formed on the control electrode, there occur cases in which the area on the toner support opposing the gate next to the former gate has an insufficient amount of toner, resultantly causing the problem of white line defects.

In the conventional art, in order to avoid the problem of white line defects, the apparatuses have been configured so that a potential difference is created and/or the size of the electrodes is varied, between the electrodes arranged on the downstream and upstream sides with respect to the position of the toner support. Such configurations might produce negative effects causing downstream dots to be greater in size or in density than upstream dots, resulting in inapt reproduction of suitable halftones. Further, these configurations need a greater number of power sources, and extra diodes and resistors for resistive division, resulting in increase in the number of parts and hence increase in size and cost of the machine as well as degrading the reliability.

There is another known prior art technique in which the voltage permitting the toner to jump (to be referred to as the ON voltage, hereinbelow) to be applied to a gate is increased only when the adjacent gate located directly before it has been used to cause the toner to jump. This prior art configuration, however, needs extra power sources for varying the voltage to be applied, separate voltage switching devices for all individual gates, which means a vast increase in the number of parts and hence increase in size and cost of the machine as well as degradation of the reliability.

Moreover, the image forming apparatuses in accordance with the conventional art may use a cylindrical sleeve as the toner support with a two-dimensional control electrode, in which the distance between each gate and the toner support is not uniform. In such a case, the jumping state of the toner varies depending on the distance. For example, in an area where the distance between the toner support and the control electrode is relatively short, the toner jumps readily because a strong electric field is formed. Inversely, in an area where this distance is greater, an insufficient amount of toner will jump because only a weak electric field can be generated. Further, the greater distance causes the jumping toner to spread and hence make the formed dot greater, resulting in reduction in dot density. Accordingly, if a halftone image, for example, is formed under these conditions, it is impossible to obtain uniform dots, let alone the desired dots, which means lack of any guarantee of suitable image density. A pattern of stripes is liable to arise because high density areas and low density areas are cyclically formed, also resulting in image degradation.

In order to avoid such drawbacks, there is another known method wherein the applied voltage is increased or the voltage application time is made longer in the areas where distances are greater. However, if the voltage application time is made longer, dots form tails so the quality of the dots degrades, and also the printing speed lowers. Further, this configuration needs more power sources and extra parts such as diodes and resistors for varying the voltage, and requires the FETs to be resistive to a higher voltage. Accordingly, it is critically important how to prevent image degradation due to ununiformity of the shape and density of the formed dots when an image forming apparatus of this type is used.

SUMMARY OF THE INVENTION

The present invention has been devised in order to solve the above problems and it is therefore an object of the present invention to provide an image forming apparatus in which a good image close to the original to be printed can be formed by preventing the image degradation due to unevenness of the shape and density of formed dots.

In order to achieve the above object, the present invention is configured as follows:

In accordance with the first aspect of the invention, an image forming apparatus at least comprises:

a supplying means having a developer support carrying the developer;

an opposing electrode disposed facing the developer support;

a high-voltage power source for supplying a high voltage to produce a potential difference between the developer support and the opposing electrode;

a control electrode at least comprising:

an insulative substrate disposed between the developer support and the opposing electrode;

a plurality of gates formed in the insulative substrate for forming the passage of the developer;

one or more electrode groups provided covering a multiple number of the gates; and a control means for applying multiple potential states to each electrode group of the control electrode, wherein the control means controls the passage of the developer through gates by applying the designated voltage to the electrode groups so as to form an image on the surface of a recording medium which is being conveyed over the opposing electrode, and is characterized in that, when the value as to a certain image-quality indicator for the first image, which is an ideal image to be formed on the recording medium surface, differs from the value as to the image-quality indicator for the second image, which is a predicated, actually formed image on the recording medium surface, by the predetermined amount, the control means restructures the image data so that the desired image can be obtained.

In accordance with the second aspect of the invention, the image forming apparatus having the above first feature is characterized in that the control means comprises an image processing means which, when pixels formed by arbitrary gates of the multiple gates can be predicted to cause ununiformity, restructures the image data to be used for printing so that the desired image can be obtained.

In accordance with the third aspect of the invention, the image forming apparatus having the above second feature is characterized in that the image processing means calculates, at least, the value of the image-quality indicator belonging to the image data, the value of the image-quality indicator belonging to the image to be printed, from the image data obtained after the image processing and the difference in the image-quality indicator between the two, and the image data is repeatedly restructured so that the difference in the image-quality indicator between the two falls within the predetermined range.

In accordance with the fourth aspect of the invention, the image forming apparatus having the above second feature is characterized in that the image processing means, at least, performs complementation, thinning, position-shifting of pixels, or modification of dot size and dot density by shifting the positions of pixels to be formed, or combinations of these, in order to restructure the image data.

In accordance with the fifth aspect of the invention, the image forming apparatus having the above first feature is characterized in that the control means, at least, performs control of an arbitrary gate of the multiple gates so as to cause the developer to transfer through the gate in three different ways: the first type transfer in which the passage of the developer through the gate will not be affected by the previous passage of the developer through the gate; the second type transfer which occurs after the developer transfer of the first type and in which the passage of the developer is affected by the first type transfer; and the third type transfer which occurs after the developer transfer of the first and second types and in which the passage of the developer is affected by the second type transfer, and the control means further comprises an image processing means for restructuring the image data so that the desired image can be formed, by taking advantage of at least one of the characteristics of the first, second and third transfer types.

In accordance with the sixth aspect of the invention, the image forming apparatus having the above fifth feature is characterized in that the image processing means restructures the image data by at least complementing or thinning pixels of data which will be of a dot formed of toner transfer of the second or third type.

In accordance with the seventh aspect of the invention, the image forming apparatus having the above fifth feature is characterized in that the image processing means restructures the image data by at least complementing or thinning pixels of data which will be of a dot formed of toner transfer of the first type.

In accordance with the eighth aspect of the invention, the image forming apparatus having the above fifth feature is characterized in that the image processing means restructures the image data by at least shifting the positions of pixels of data.

In accordance with the ninth aspect of the invention, the image forming apparatus having the above fifth feature is characterized in that the image processing means restructures the image data by at least changing the number of pixels which will be of a dot of the first transfer type, and the number of pixels which will be of a dot of the second or third transfer type.

In accordance with the tenth aspect of the invention, the image forming apparatus having the above fifth feature is characterized in that the image processing means achieves data restructuring by at least, dividing the image data into multiple areas to extract the characteristic value from each area and determining the contents of restructuring the image data based on the extracted characteristic values.

In accordance with the eleventh aspect of the invention, the image forming apparatus having the above first feature is characterized in that a plurality of supplying means each having a different color of developer are provided to form color images and the control means restructures the image data for each color of developer, separately.

In accordance with the twelfth aspect of the invention, the image forming apparatus having the above second feature is characterized in that the image processing means is installed in a separate appliance which is connected to the image forming apparatus.

In accordance with the thirteenth aspect of the invention, a recording medium for storing an image forming control program for controlling an image forming apparatus at least which comprises:

a supplying means having a developer support carrying the developer;

an opposing electrode disposed facing the developer support;

a high-voltage power source for supplying a high voltage to produce a potential difference between the developer support and the opposing electrode;

a control electrode at least comprising:

an insulative substrate disposed between the developer support and the opposing electrode;

a plurality of gates formed in the insulative substrate for forming the passage of the developer;

one or more electrode groups provided covering a multiple number of the gates; and a control means for applying multiple potential states to each electrode group of the control electrode, so that the control means applies voltages to the electrode groups to control the passage of the developer through the gates to thereby form an image on the surface of a recording medium being conveyed over the opposing electrode, is characterized in that an image forming control program is stored therein which instructs the control means to restructure the image data so that the desired image can be obtained, when the value as to a certain image-quality indicator for the first image, which is an ideal image to be formed on the recording medium surface, differs from the value as to the image-quality indicator for the second image, which is a predicated, actually formed image on the recording medium surface, by the predetermined amount.

DESCRIPTION OF THE PREFERRED EMBODIMENTS

The embodiment of the invention will hereinafter be described with reference to the accompanying drawings.

Figure 1:
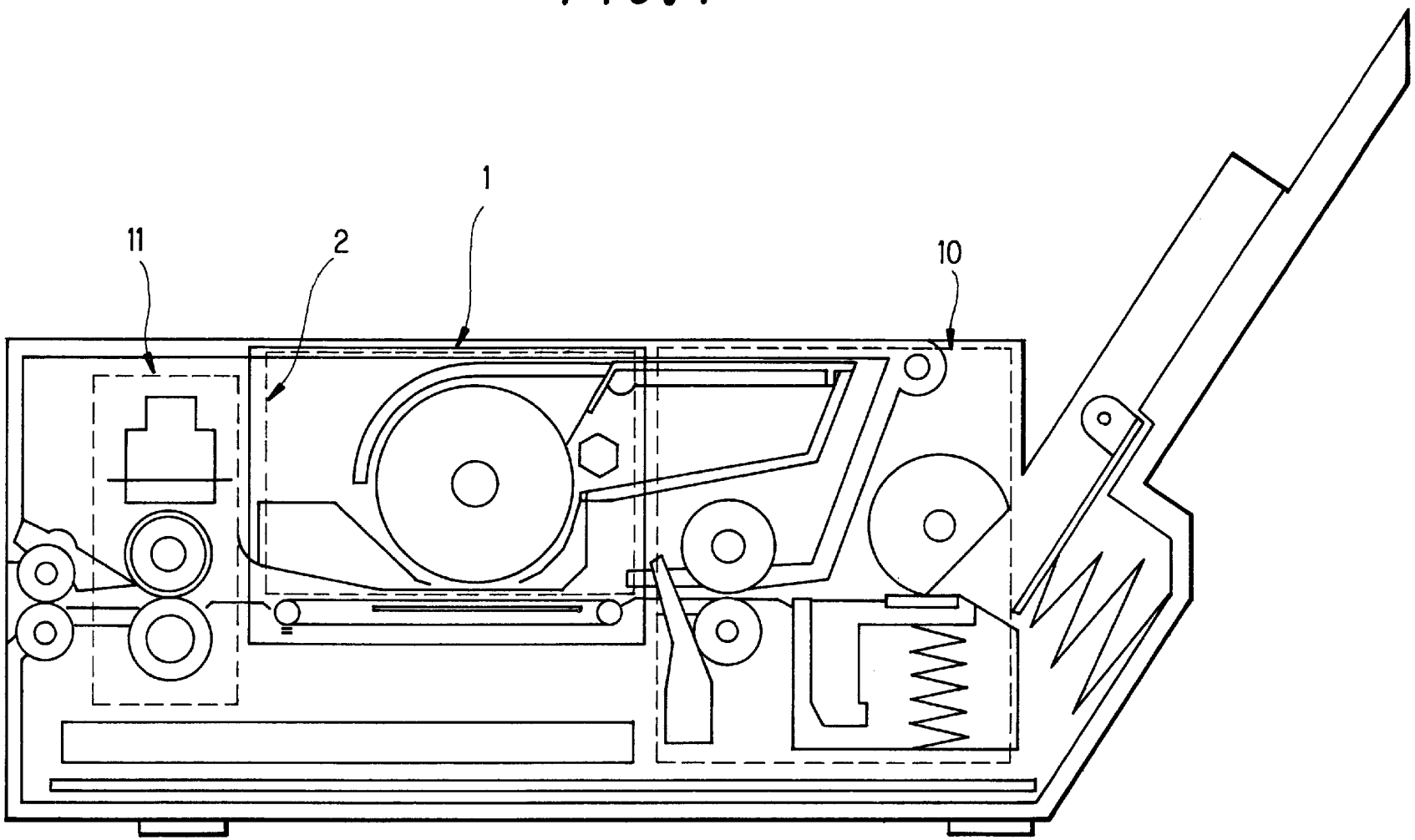
FIG. 1 is a block diagram showing the configuration of an image forming apparatus in accordance with the embodiment.

FIG. 1 is a sectional view showing a printer in which an image forming apparatus in accordance with the embodiment is mounted.

As seen in this figure, this printer comprises: an image forming unit 1 which is composed of a toner supplying section 2 and a printing section 3; a paper feeder 10 for supplying sheets of paper to image forming unit 1; and a fixing unit 11 for fixing the toner image which has been formed on the paper by image forming unit 1.

Focusing on this image forming unit 1, the configuration of the components of the printer will hereinbelow be described.

Figure 2:
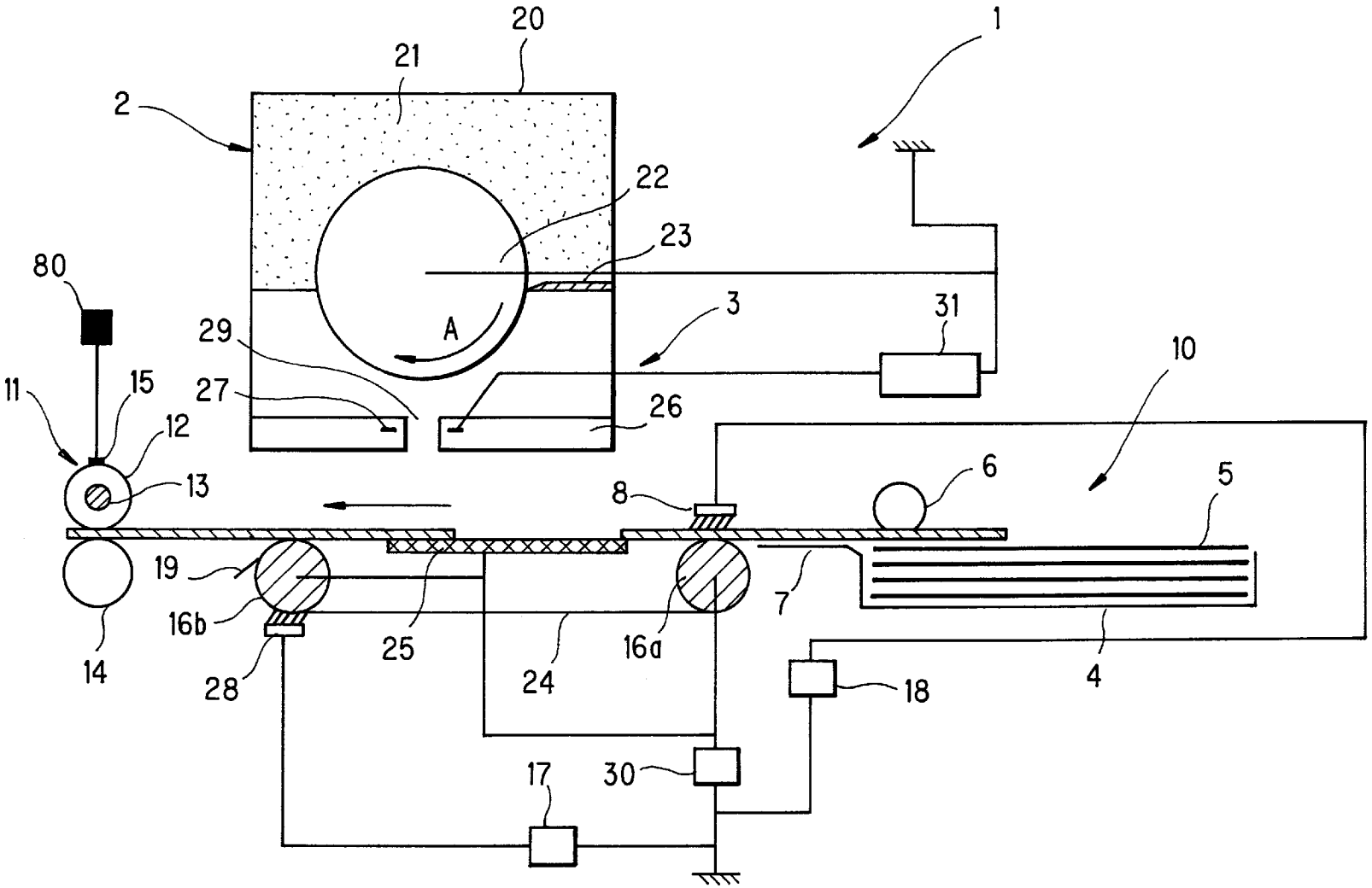
FIG. 2 is a sectional view showing the printer used in the embodiment.

FIG. 2 is a block diagram showing an illustrative configuration of the components of the printer shown in FIG. 1. In the following description, a configuration for negatively charged toner will be described, but the polarity of voltages to be applied may be appropriately set if positive charged toner is used.

Image forming unit 1 shown in this figure creates a visual image in accordance with an image signal, onto a sheet of paper as recording medium with toner as the developer. More specifically, in this image forming unit, the toner is made to jump and adhere onto the paper whilst the jumping of the toner is controlled based on the image forming signal so as to directly create an image on the paper.

A paper feeder 10 is provided on the input side of image forming unit 1. Paper feeder 10 is composed of a paper cassette 4 for storing paper 5 as recording medium, a pickup roller 6 for delivering paper 5 from paper cassette 4, and a paper guide 7 for guiding fed paper 5. Paper feeder 10 further has an unillustrated detecting sensor for detecting the feed of paper 5. Pickup roller 6 is rotationally driven by an unillustrated driving means.

Provided on the output side of image forming unit 1 is a fixing unit 11 for heating and pressing the toner image which was formed on paper 5 at the image forming unit 1, to fix it onto paper 5. Fixing unit 11 is composed of a heat roller 12, a heater 13, a pressing roller 14, a temperature sensor 15, a temperature controller circuit 80 and an unillustrated paper discharge sensor. Heat roller 12 is made up of, for example, an aluminum pipe of 2 mm thick. Heater 13 is a halogen lamp which is incorporated in heat roller 12. Pressing roller 14 is made of silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts.

Temperature sensor 15 measures the surface temperature of heat roller 12. Temperature controller circuit 80 which is controlled by a main controller, performs the on/off operation of heater 13 and other control based on the measurement of temperature sensor 15, to maintain the surface temperature of heater roller 12 at 150° C. An unillustrated paper discharge sensor is the one which detects the discharge of paper 5.

The materials of heat roller 12, heater 13, pressing roller 14, etc., are not specifically limited. The surface temperature of heat roller 12 also is not specifically limited. Further, fixing unit 11 may use a fixing configuration in which paper 5 is heated or pressed to fix the toner image.

Further, although it is not shown in the drawing, the paper output side of fixing unit 11 has a paper discharge roller for discharging paper 5 processed through fixing unit 11 onto a paper output tray and a paper output tray for holding paper 5 thus discharged. Heat roller 12, pressing roller 14 and the paper discharge roller are rotated by an unillustrated driving means.

Next, toner supplying section 2 as a component of image forming unit 1 will be described illustratively. As shown in FIG. 1, toner supplying section 2 is composed of a toner storage tank 20 for storing toner 21 as the developer, a toner support 22 of a cylindrical sleeve for supporting toner 21 and a doctor blade 23 which is provided inside toner storage tank 20 to electrify toner 21 and regulate the thickness of the toner layer carried on the peripheral surface of toner support 22.

Doctor blade 23 is arranged on the upstream side with respect to the rotational direction of toner support 22, spaced with a distance of about 60 $\mu$m from the peripheral surface of toner support 22. Toner 21 is of a non-magnetic type having a mean particle diameter of 6 $\mu$m, and is electrified with static charge of $-4$ $\mu$C/g to $-5$ $\mu$C/g by doctor blade 23. Here, the distance between doctor blade 23 and toner support 22 is not particularly limited. Also the mean particle size, the amount of static charge, etc., of toner 21 are not particularly limited.

Toner support 22 is rotationally driven by an unillustrated driving means in the direction indicated by arrow A in the figure. Toner support 22 is grounded and has unillustrated magnets arranged therein, at the position opposite doctor blade 23 and at the position opposite a control electrode 26 (which will be described later). Toner support 22 can carry toner 21 on its peripheral surface. Toner 21 supported on the peripheral surface of toner support 22 is made to stand up in 'spikes' at the areas on the peripheral surface corresponding the positions of aforementioned magnets. Rotating speed of toner support 22 is not particularly limited. Here, the toner is supported by magnetic force, but toner support 22 can be configured so as to support toner 21 by electric force or combination of electric and magnetic forces.

Next, a specific description will be made of printing section 3 as a component of image forming unit 1.

Printing section 3 includes: an opposing electrode 25 which is made up of an aluminum sheet of 1 mm thick and faces the peripheral surface of toner support 22; a high-voltage power source 30 for supplying a high voltage to opposing electrode 25; a control electrode 26 provided between opposing electrode 25 and toner support 22; a charge erasing brush 28; a charge erasing power source 17 for applying a charge erasing voltage to charge erasing brush 28; a charging brush 8 for charging sheet 5; a charger power source 18 for supplying a charger voltage to charging brush 8; a dielectric belt 24; support rollers 16*a* and 16*b* for supporting dielectric belt 24; and a cleaner blade 19.

Opposing electrode 25 is arranged 1.1 mm apart from the peripheral surface of toner support 22. Dielectric belt 24 is made of PVDF as a base material, and is 75 $\mu$m thick with a volume resistivity of $10^{10}$ $\Omega$·cm. Dielectric belt 24 is rotated by an unillustrated driving means in the direction of the arrow in the drawing, at a surface speed of 30 mm/sec. Applied to opposing electrode 25 is a high voltage of 2.3 kV from high voltage power source 30 so that this generates an electric field between opposing electrode 25 and toner support 22, required for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26, and has an erasing potential of 2.5 kV applied from charge erasing power source 17 so as to eliminate unnecessary charges remaining on the surface of dielectric belt 24. Cleaning blade 19 functions as follows: if some toner 21 adhered to the surface of dielectric belt 24 due to a contingency such as paper jam, etc., cleaning blade 19 removes this toner 21 to prevent staining by toner 21 on the paper underside.

Neither the material of opposing electrode 25 nor the distance between opposing electrode 25 and toner support 22 is particularly limited. Further, the rotational speed of opposing electrode 25 or the voltage to be applied thereto is not particularly limited either.

Although not illustrated for convenience sake of the description, this image forming unit 1 includes: a main controller for controlling the whole image forming apparatus; an image processor for converting the image data into a predetermined format to be printed; an image memory for storage of the image data; and an image forming control unit for converting the image data obtained from the image processor into the image data to be given to control electrode 26.

Control electrode 26 is disposed in parallel to opposing electrode 25 and spreads two-dimensionally facing opposing electrode 25, and it has a structure to permit the toner to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled.

Control electrode 26 is arranged so that its distance from the peripheral surface of toner support 22 is set at 100 $\mu$m, for example, and is secured by means of an unillustrated supporter member.

Next, a specific configuration of this control electrode 26 will be described.

Figure 3:
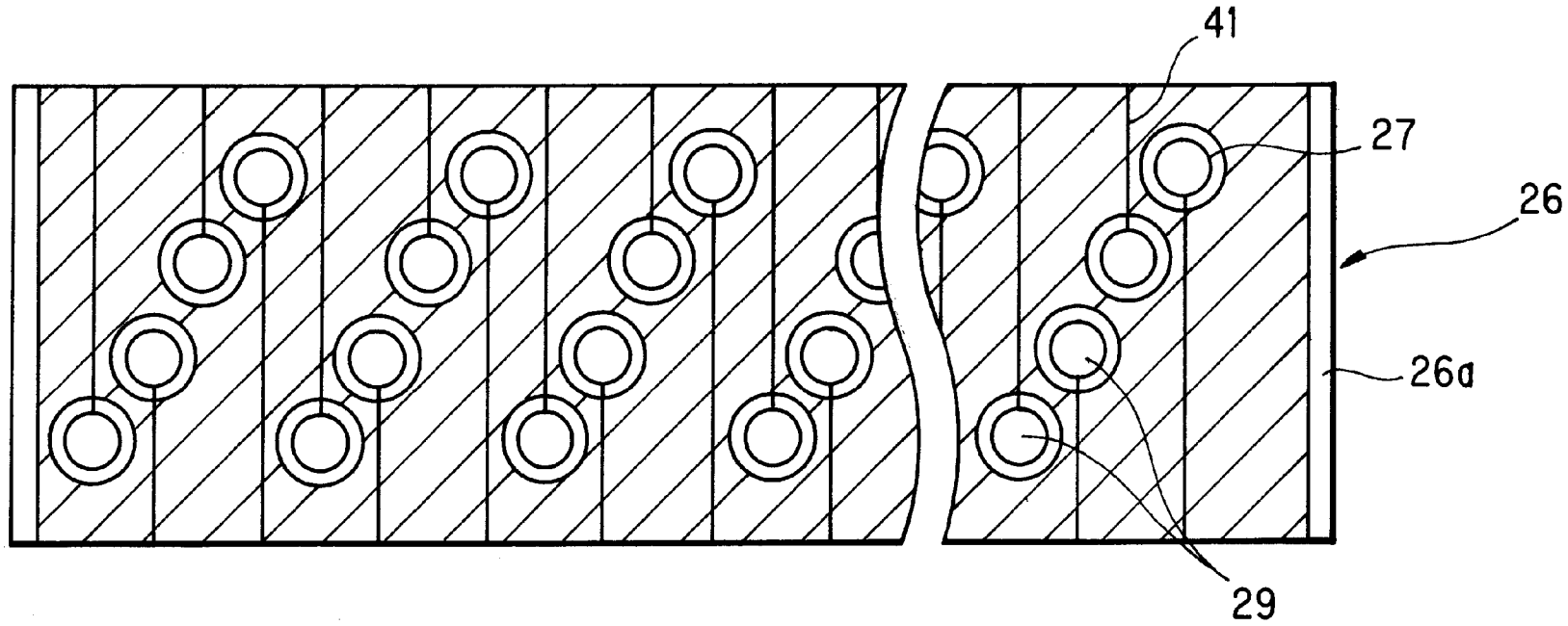
FIG. 3 is a view showing a configuration of the control electrode used in the image forming apparatus shown in FIG. 1.

FIG. 3 is a diagram showing a specific configuration of control electrode 26 shown in FIG. 1. As shown in this figure, control electrode 26 is composed of an insulative board 26*a*, a high voltage driver (not shown), annular conductors independent of one another, i.e., annular electrodes 27.

Board 26*a* is made from a polyimide resin with a thickness of 25 $\mu$m. The board further has holes forming gates 29, to be mentioned later, formed therein. Annular electrodes 27 are formed of copper foil of 18 μm thick and are arranged around the holes, in a predetermined layout. Each opening of the hole is formed with a diameter of 160 μm, forming a passage for toner 21 to jump from toner support 22 to opposing electrode 25. This passage will be termed gate 29 hereinbelow. Further, each annular electrode 27 is provided with an opening of 200 μm in diameter.

Here, the distance between control electrode 26 and toner support 22 is not particularly limited. The size of gates 29 and the materials and thickness of insulative board 26*a* and annular electrodes 27 are also not particularly limited. The holes of annular electrodes 27, i.e., gates 29 are formed at 2,560 sites. Each annular electrode 27 is electrically connected to a control power source 31 via feeder line 41 and an unillustrated high voltage driver. The number of annular electrodes 27 is not particularly limited.

The surface of annular electrodes 27 and the surface of feeder lines 41 are covered with an insulative layer 26*c* of 30 μm thick, which ensures insulation between annular electrodes 27, insulation between feeder lines 41, insulation between annular electrodes 27 and feeder lines 41 which are not connected with each other, insulation from toner support 22 and insulation from opposing electrode 25.

Supplied to annular electrodes 27 of control electrode 26 are voltages or pulses in accordance with the image signal from control power source 31. Specifically, when toner 21 carried on toner support 22 is made to pass toward opposing electrode 25, control power source 31 applies a voltage of 150 V (to be referred to as the ON potential, hereinbelow) to annular electrodes 27. When the toner is blocked from passing, a voltage of −200 V (to be referred to as the OFF potential, hereinbelow) is applied thereto.

In this way, whilst the potential to be imparted to control electrode 26 is controlled in accordance with the image signal, a sheet of paper 5 is fed over opposing electrode 25 on the side thereof facing toner support 22. Then, a toner image is formed on the surface of paper 5 in accordance with the image signal. Here, control power source 31 is controlled by a control electrode controlling signal transmitted from an unillustrated image forming control unit. The above image forming unit 1 in accordance with this embodiment can be applied to an output printer for computers, word processors as well as the printing portion of digital copiers.

The following description will be the case where the image forming unit of this embodiment is used as the printing portion of a digital copier.

Figure 4:
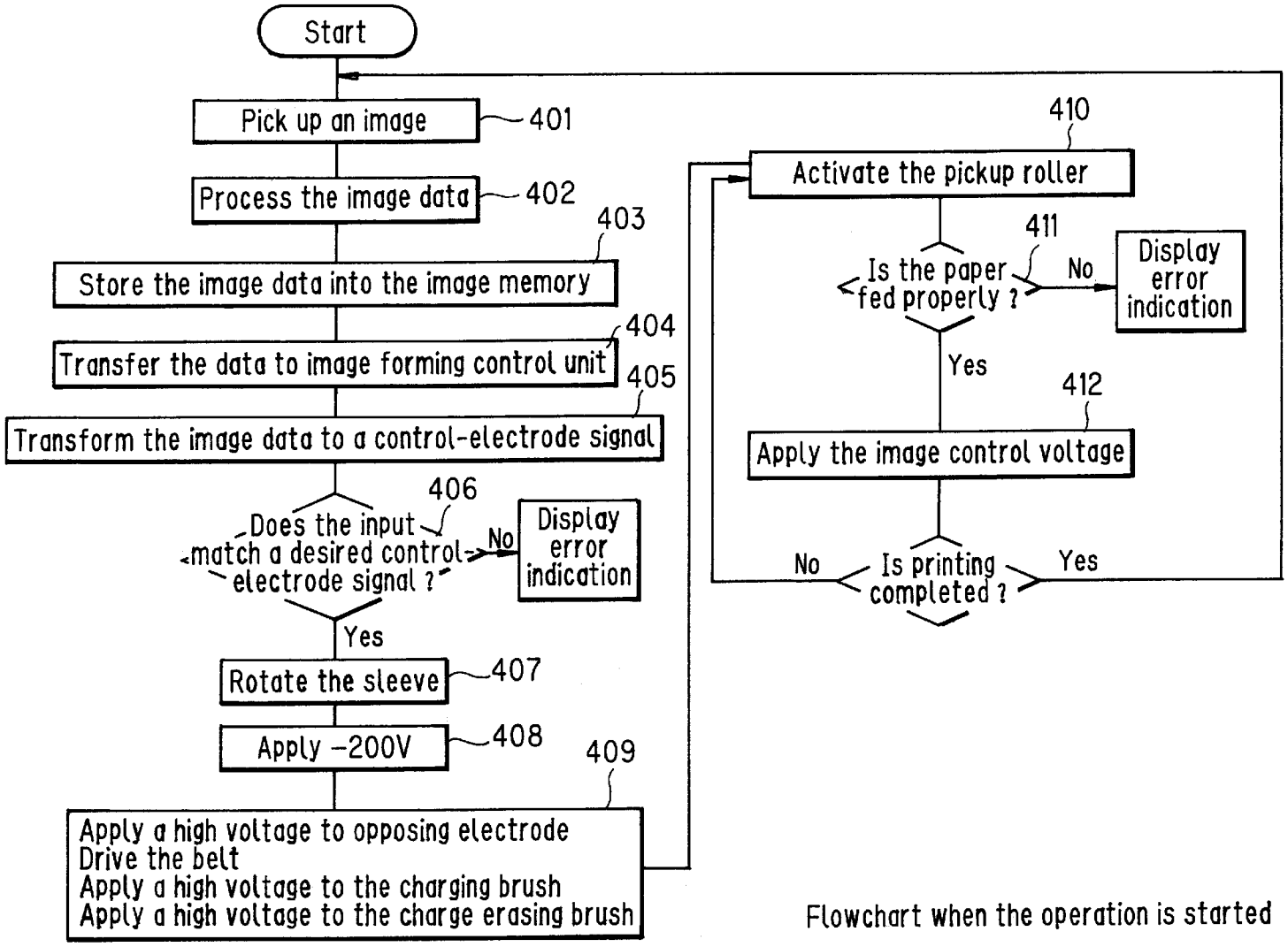
FIG. 4 is a flowchart showing the operation of printing.

FIG. 4 is a flowchart showing procedural steps of the image forming process when the image forming unit of this embodiment is used as the printing portion of a digital copier. As shown in this figure, first, when the copy start key is operated with an original to be copied set on the image pickup section, the main controller, in response to this input, starts the image forming operation.

Specifically, the image pickup section starts to read the image from the original (Step 401). The image data thus read is image processed in the image processing section (Step 402) to be stored into the image memory (Step 403). This image data thus stored in the image memory is then transferred to the image forming control unit (Step 404). This image forming control unit converts the input image data into a control electrode controlling signal to be given to control electrode 26 (Step 405). When the image forming control unit acquires a predetermined amount of the control signal (Step 406), the sleeve starts to rotate (Step 407) and a voltage of −200 V is applied (Step 408). Then high voltages are applied to opposing electrode 25, the charging brush and the charge erasing brush whilst the belt is being driven (Step 409).

Thereafter, an unillustrated driver is activated to rotate pickup roller 6 illustrated in FIG. 2, which delivers a sheet of paper 5 out from paper cassette 4 toward image forming unit 1 (Step 410). At that moment, at Step 411, it is judged by a feed sensor whether the paper is fed normally or not. Paper 5 delivered out by pickup roller 6 is conveyed between charging brush 8 and support roller 16. A voltage equal to the potential of opposing electrode 25 is applied to support member 16*a* from high voltage power source 30 while charging brush 8 is applied with a charging potential of 1.2 kV from charger power source 18 (Step 412).

As a result, paper 5 is supplied with charges due to the potential difference between charging brush 8 and support member 16*a,* so that paper 5 is, whilst it is electrostatically attracted to dielectric belt 24, is conveyed to a position in printing section 3 of image forming unit 1, where dielectric belt 24 faces control electrode 26. The aforementioned predetermined amount of the control electrode controlling signal may be different depending on the configuration etc. of the image forming apparatus.

Thereafter, the image forming control unit supplies the control electrode controlling signal to control power source 31. This control electrode controlling signal is supplied at a time synchronized with the supply of paper 5 from charging brush 8 to printing section 3.

Control power source 31 controls the voltages to be applied to annular electrodes 27 of control electrode 26 based on this control electrode controlling signal.

Illustratively, the voltage, 150 V or −200 V is appropriately applied as appropriate to predetermined annular electrodes 27 from control power source 31 so as to control the electric field around control electrode 26. Accordingly, at each gate 29 of control electrode 26, the jumping of toner 21 from toner support 22 toward opposing electrode 25 is prevented or permitted appropriately in accordance with the image data. Thus, a toner image in conformity with the image signal is formed on paper 5 which is moving at the rate of 30 mm/sec toward the paper output side by the advance of dielectric belt 24 over the surface of opposing electrode 25.

Paper 5 with the toner image formed thereon is separated from dielectric belt 24 by the curvature of support member 16*b* and is conveyed to fixing unit 11, where the toner image is fixed to paper 5. Paper 5 with the toner image fixed thereon is discharged by the discharge roller onto paper output tray. At the same time, the fact that the paper is normally discharged is detected by the paper discharge sensor. Then, the main controller judges the printing operation to be normally completed, from the above detection.

By the series of image forming steps described above, a good image is created on paper 5. Since this image forming apparatus directly forms the image on paper 5, it is no longer necessary to use a developer medium such as photoreceptor, dielectric drum, etc., which were used in conventional image forming apparatuses. In this way, in accordance with this image forming process, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus in size and cost.

The image forming apparatus of the above embodiment may be used as the printing portion of an output terminal for a computer or may be used as the printing portion of a digital copier. In either case, the method of the image forming operation itself has no difference from the other though the image signal to be processed and the way of signal exchange differ in each case.

Since toner support 22 is grounded while opposing electrode 25 and support member 16*a* have a high voltage of 2.3 kV applied and charging brush 8 has a high voltage of 1.2 kV applied, negative charge is supplied to the surface of paper 5 fed between charging brush 8 and dielectric belt 24, by the potential difference between charging brush 8 and support member 16*a*.

As supplied with negative charge, paper 5 is attracted to dielectric belt 24 by the static electric force of the charge and is conveyed to directly below gates 29 as dielectric belt 24 moves. The surface potential of paper 5 attenuates with time, hence, when it reaches directly below gates 29 the paper will have a surface potential of 2 kV due to the equilibrium with the potential of opposing electrode 25.

In this condition, in order for toner 21 carried on toner support 22 to pass toward opposing electrode 25, control power source 31 is caused to apply a voltage of 150 V to annular electrodes 27 of control electrode 26. When toner 21 needs to be stopped passing through gates 29, a voltage of −200 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired. Further, the voltage to be imparted to annular electrodes 27 of control electrode 26 to prevent passage of toner 21 should not be particularly limited.

Up to now, the configuration and procedural steps of the image forming apparatus in accordance with this embodiment were discussed.

Next, the jumping control of toner 21 effected in the image forming apparatus of this embodiment will be described.

Figure 5:
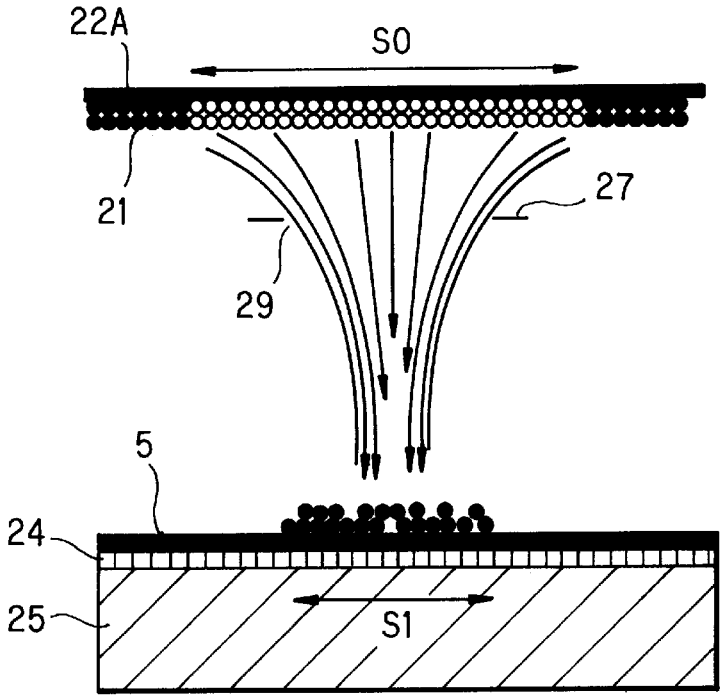
FIG. 5 is a jumping state of toner.
Figure 6:
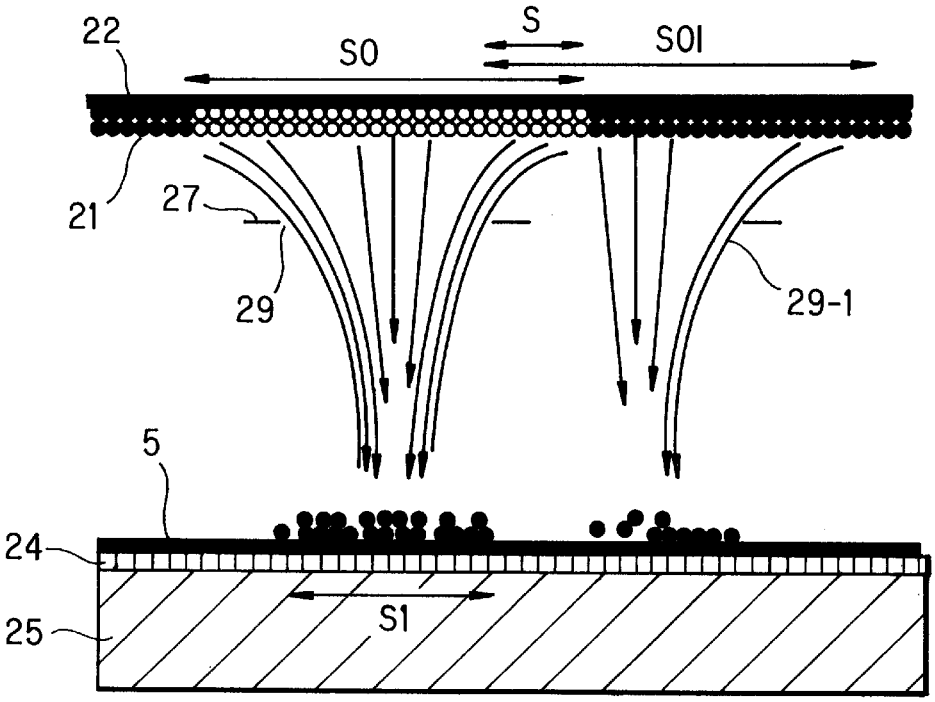
FIG. 6 is a jumping state of toner.

FIGS. 5 and 6 are schematic views showing the jumping of toner 21.

As shown in FIG. 5, when the ON potential is applied to an annular electrode 27 of gate 29 provided on control electrode 26, toner 21 supported on toner support 22 jumps from an effective area S0 and converges during jumping to reach the surface of paper 5, forming a dot. When the area of the dot formed on the surface of paper 5 is represented by S1, then S0>S1. This way of the transfer of toner 21 to gate 29 will be called 'first type toner transfer'.

Now consider a case where toner 21 jumps toward a gate 29-1 adjacent to gate 29 through which first type toner transfer has occurred. As shown in FIG. 6, an insufficient amount of toner 21 transfers through gate 29-1. This transfer of toner 21 to gate 29-1 will be called 'second type toner transfer'. Further, in another case where toner 21 jumps toward another gate 29-2 next to gate 29-1 through which second type toner transfer has occurred, transfer of an insufficient amount of toner 21 occurs again. This transfer of toner 21 to gate 29-2 will be called 'third type toner transfer'.

To sum up, first type toner transfer is one which affects the size and density of the dot (to be formed by second type toner transfer) for a neighboring gate 29, or one which is not affected at all by previous transfer of toner 21; second type toner transfer is one which is affected as to dot size and density by first type toner transfer; and third type toner transfer is one which is affected as to its dot size and density by second type toner transfer.

Now, a further description in detail in this respect will be made. In FIG. 6, when toner 21 is caused to jump through gate 29-1, toner 21 will be caused to jump from effective area S01 which is equi-sized to effective area S0 for gate 29. However, there is an area S without toner 21 residing in it, within the effective area S01 on toner support 22 for gate 29-1 because toner 21 on this area has already transferred from the previous transfer caused by neighboring gate 29 (from first type toner transfer). As a result, if toner 21 is caused to transfer under such conditions, an insufficient amount of toner 21 will transfer and hence the desired dot size and density cannot be obtained.

Figure 7:
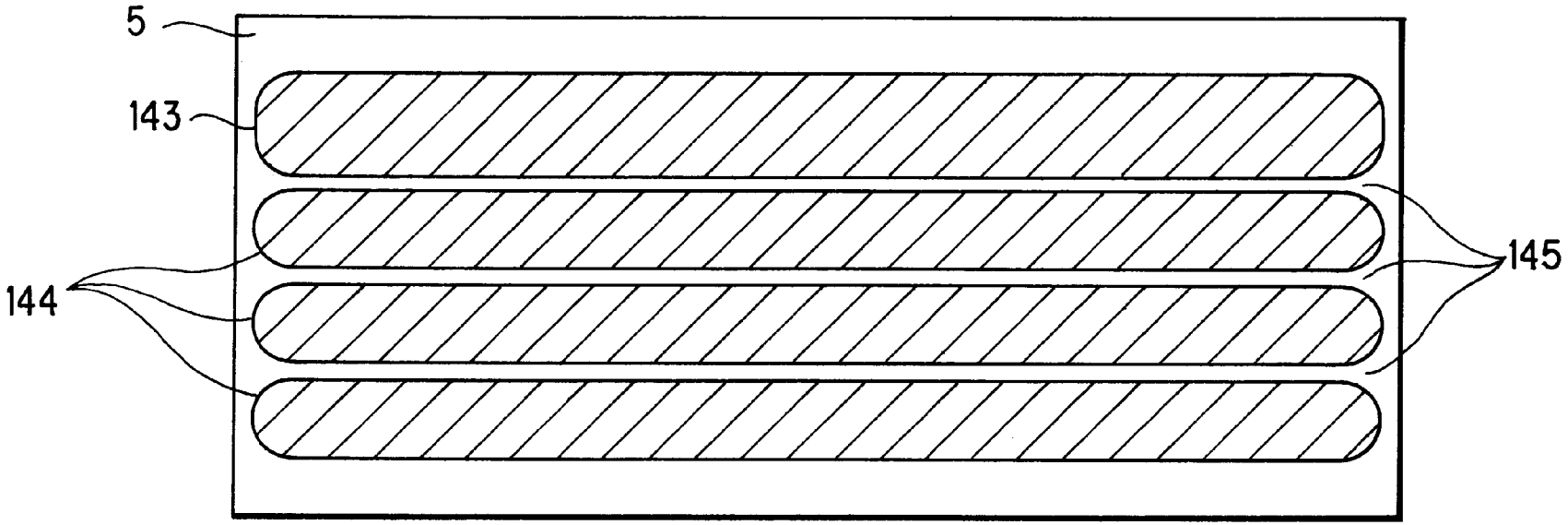
FIG. 7 is an illustration of white line defects.

Similarly, when toner 21 is caused to jump through gate 29-2 which is adjacent to gate 29-1, third type toner transfer occurs which cannot produce a dot having large enough diameter and high enough density. Therefore, when a solid image is to be formed under these conditions, the result is only a striped image with white lines therein as shown in FIG. 7 because the dots obtained by the second or third type toner transfer are lacking in dot size and density, causing gaps between the dots.

Illustratively, a line 143 is formed on paper 5 by the dots obtained through first type toner transfer, while lines 144 are formed on the paper by the dots obtained through second and third type toner transfer. The dots obtained through second or third type toner transfer do not have large enough size as stated above, hence line 144 is lacking in line width. Resultantly, gaps 145 (which will be referred to as 'white line defects') occur between lines 144 and/or lines 143 and 144.

Conventionally, in order to avoid the occurrence of white line defects 145, the conditions of the layer of toner 21 on toner support 22, the level of the ON voltage, and the application time of the ON voltage were controlled so that lines obtained through second type toner transfer could be made wide enough. In some configurations, for example, the conveyed amount of toner was increased, in other configurations the ON voltage was increased. These countermeasures can realize the avoidance of the occurrence of white line defects on the one hand, but the dots formed by first type toner transfer increase in size on the other hand. As a result, when a halftone image needs to be formed, the size of dots cannot be made uniform as shown in FIG. 8, producing an unpreferred image.

Figure 8:
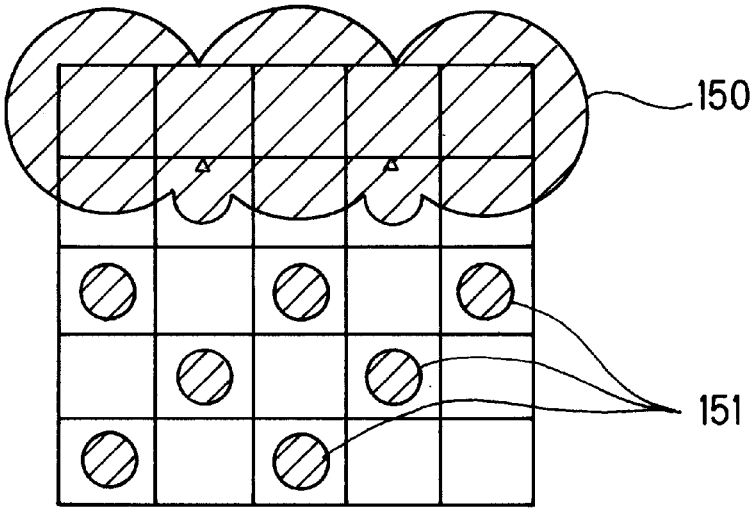
FIG. 8 is an illustration of white line defects.

In FIG. 8, dots 150 and 151 are obtained by first and second type transfer, respectively. Dot 150 is greater than dot 151. Therefore, in this case, it is not only difficult to reproduce a desired halftone but the large-sized dots produced by first type toner transfer cause a striped pattern to appear, degrading the image.

Here, consider a case where the apparatus is configured so that the layer of toner 21 is controllable. For example, if the conveyed amount of toner is increased, the layer's formation tends to become unstable and the apparatus needs more parts for acceptable layer formation to be made, increasing the size and cost of the machine and degrading the reliability. It is also unpreferable because an excessive amount of toner 21 is caused to jump. On the other hand, when the apparatus is configured so that the voltage is controllable, the configuration needs an increased number of power sources with more parts such as diodes, resistors and the like for resistive division, resulting in increase in size and cost of the machine as well as degrading the reliability.

Control of the applied voltage can also be considered, by for example, controlling the pulse width or by shifting the formation position of dots, by a ½ pixel, for example. However, because each electrode needs an individual control circuit for controlling the pulse width or the pulse timing, this method needs a large number of extra parts, hence increasing the size and cost of the machine as well as degrading the reliability.

Hence, any of the above technologies cannot avoid the incrementing the number of parts, increasing the size and cost of the machine and degrading the reliability.

Figure 9:
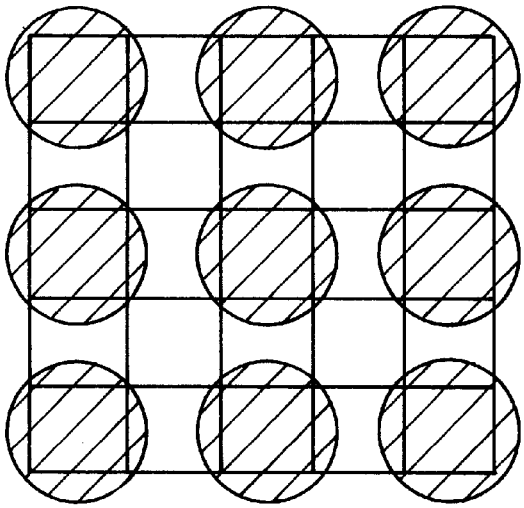
FIG. 9 is an illustration showing a form of a halftone image.

The problem of second type toner transfer occurs when printing is effected through successive neighboring gates 29. Therefore, when a dot pattern is formed by gates 29 not proximal to each other, as shown in FIG. 9, no or little second type toner transfer will occur. Rather, the aforementioned prior art countermeasures might have a negative effect. For example, when the voltage to be applied to annular electrodes 27 or the size of annular electrodes 27 is increased as they approach the downstream side with respect to the toner support 22, printing implemented with gates 29, not proximal to each other, necessarily makes the dots greater as gates 29 disposed more downstream are involved. Actually, it is not always true that second type toner transfer occurs only after first type toner transfer. There are some cases in which a dot of the first type is formed on the downstream side of a dot of the second type.

This will be described referring to FIG. 10. In this figure, dots 150 are of the first type and dots 151 are of the smaller diameter, that is, formed by second type toner transfer. A dot 152 is one which was formed by a gate 29 that is located on the downstream side of the gate 29 through which the dot 150 was formed and is of the first type. In this way, the size and density differences between dots formed by first type toner transfer and by second type toner transfer are further enhanced, conversely causing a situation in which a desired halftone cannot be obtained.

There is another prior art technique in which the ON voltage for toner transfer is controlled so that the ON voltage for toner transfer of the second type is increased only when successive neighboring gates 29 are used for printing. This configuration, however, needs extra power sources for varying the voltage to be applied, extra resistors and/or diodes, with voltage switching means for each gate, which means a vast increase in the number of parts, increase in size and cost of the machine as well as degradation of the reliability. In conclusion, it is far too problematic and troublesome to achieve a configuration in which the ON voltage, the size of the electrodes, or the layer of toner 21 is controlled in a variable manner, in order to reduce white line defects.

Up to now, the details of the problems facing this embodiment have been described.

Next, the jumping control employed by the present embodiment will be described with specific examples.

In this embodiment, in order to obtain a desired halftone image, the image data is subjected to an additional process, taking into account the fact that dots reduce in size or density in areas where white line defects occur. More specifically, the image data is processed so as to acquire a desired density by modifying the number of dots, the positions of dots, or the numbers of dots formed by toner transfer of the first, second and third types, or using a combination of these modifications.

Figure 11A:
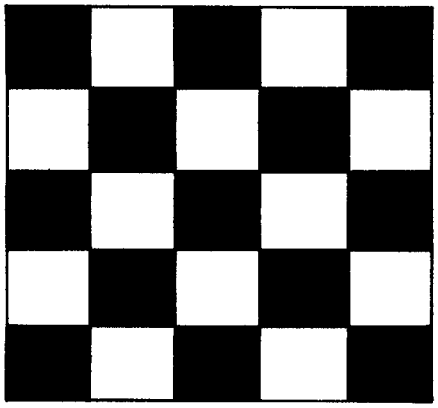
FIGS. 11A and 11B illustrate an example of image data.
Figure 11B:
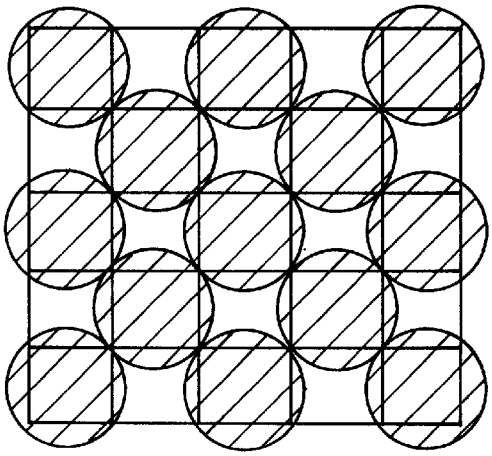

Now, consider a case where part of the image to be reproduced includes the image data shown in FIG. 11A. Suppose that an image shown in FIG. 11B is reproduced from this image data assuming no toner transfer of the first and second types occurs. In an actual process, since toner transfer of the first and second types occurs, dots having a smaller size shown in FIG. 8 are formed, lowering the image density and hence resulting in loss of the desired halftone.

To deal with this, the present embodiment is configured so that dots obtained through the second and third type toner transfer will be increased in number within the image area. For example, the original image data is converted into that shown in FIG. 12A, to thereby effect image formation. The reason for this is that if the final print is formed with the image data shown in FIG. 12A, the image shown in FIG. 12B will be obtained, producing a halftone which corresponds to the desired one.

In this way, in accordance with this embodiment, the image data is restructured so that the density of the final, obtained image will meet the desired one. It should be noted that, when the image data is restructured so as to compensate for dots formed by second type toner transfer in the way shown in FIGS. 12A and 12B, it is possible to adjust the image density obtained in a more fine manner because the dot itself of the second type is small in size and low in density. Thus, a more preferable image can be restructured.

Next, referring to FIGS. 13A through 19D, other examples of data restructure will be explained.

Figure 13A:
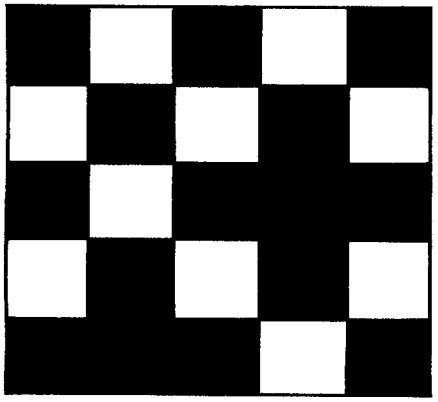
FIGS. 13A and 13B illustrate an exemplary way of image data restructuring.
Figure 13B:
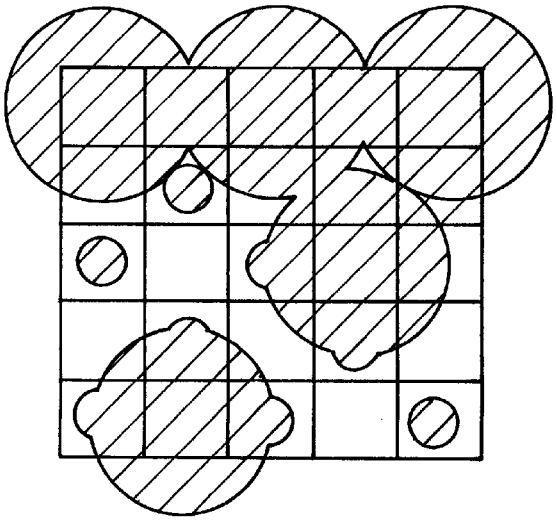

First, in the case where first type toner transfer is obtained, the original data is converted into that shown in FIG. 13A, and then dots of the first type are created to obtain the image shown in FIG. 13B.

This method is characterized by complementation using dots of the first type. Since dots of the first type are of a greater dot diameter and of a higher density, the image can be reproduced with a lower number of dots. Thus, this method provides for a desirable restructure of image data, with a minimal increase in the image data after the restructuring.

Figure 14A:
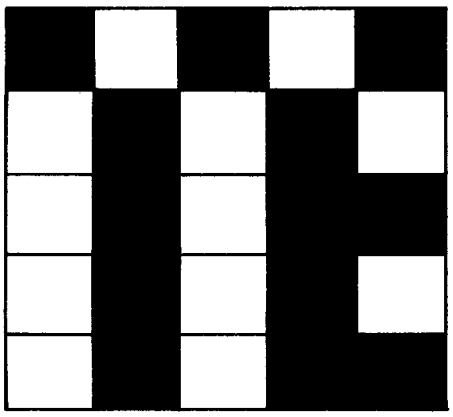
FIGS. 14A and 14B illustrate an exemplary way of image data restructuring.
Figure 14B:
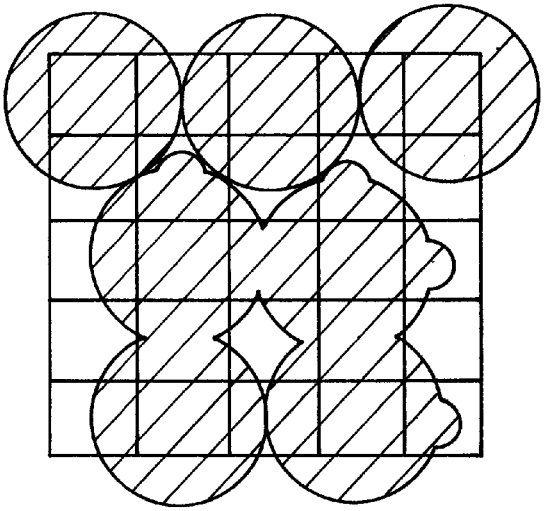

Next, there is a case where some dots of the second type can be replaced by dots of the first type, by shifting the position of the pixels of data which would from dots of the second type. In such a case, the positions of dot formation are transferred as shown in FIG. 14A, to positions at which dots of the first type can be obtained. FIG. 14B shows the image obtained as a result of this process. In this case, the amount of image data after the restructuring does not increase at all. Further, when a large number of dots of the first type can be obtained by the above process, this method provides a desirable restructure of image data with a reduced amount of image data.

The next case is one where some dots can be shifted or some dots can be shifted with some new dots added. As an example, when the image data shown in FIG. 15A is converted into that shown in FIG. 15B, the image shown in FIG. 15C can be obtained. There are cases where dots of the first type cause striping of lines when the above correction is performed. Therefore, it is possible to convert the image data so as to omit certain dots of the first type from the image data shown in FIG. 16A, and produce the image data shown in FIG. 16B, thus obtaining the image shown in FIG. 16C.

It is further possible to shift some of the dots to be printed, or thin some of the dots after shifting. For example, the original image data is converted into the image data shown in FIG. 17A so as to obtain the image shown in FIG. 17B.

When the process shown in FIGS. 16A, 16B and 16C, or FIGS. 17A, 17B and 17C, is effected, striping attributed to dots of the first type can be inhibited, but there are cases where the resulting image presents an insufficiency of image density or halftone density. In such a case, it is possible to adjust the data so that dots which would have been the second type can be obtained as the first type by thinning some of the dots of the first type. For example, the image shown in FIG. 17C can be obtained by this method. When the process shown in FIGS. 16A, 16B and 16C or that shown in FIGS. 17A, 17B and 17C cannot produce high enough density, the processes illustrated with reference to FIGS. 12A through FIG. 15C can also be used in combination.

Figure 16B:
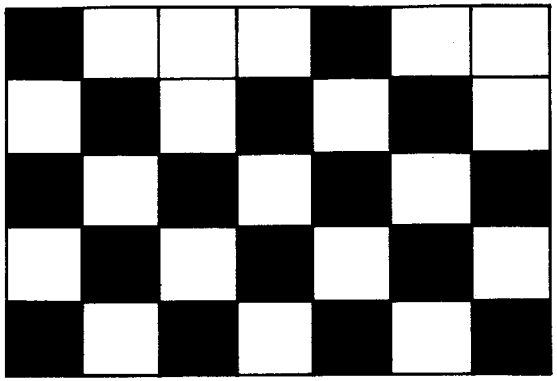
FIGS. 16A through 16C illustrate an exemplary way of image data restructuring.
Figure 16A:
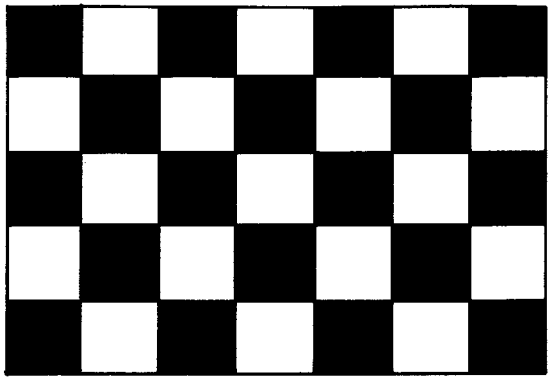
Figure 16C:
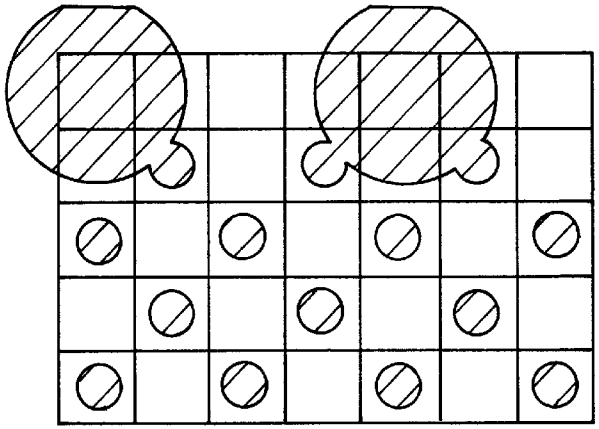
Figure 18B:
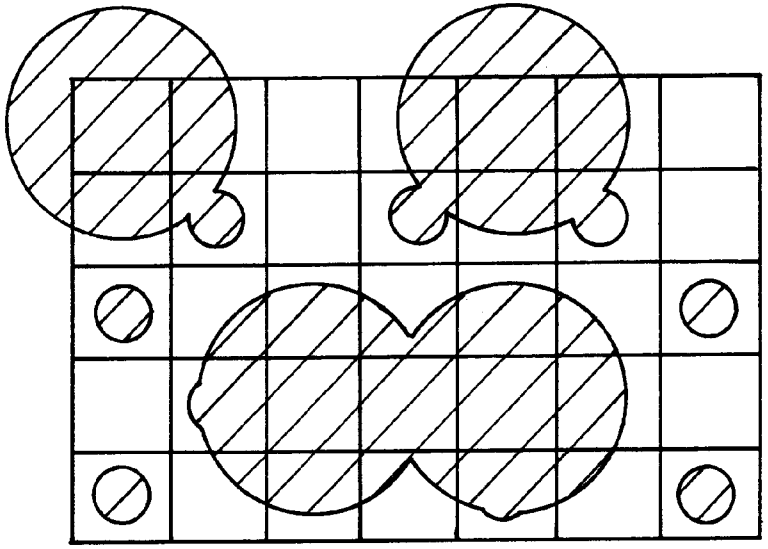
FIGS. 18A and 18B illustrate an example showing a way of image data restructuring.
Figure 18A:
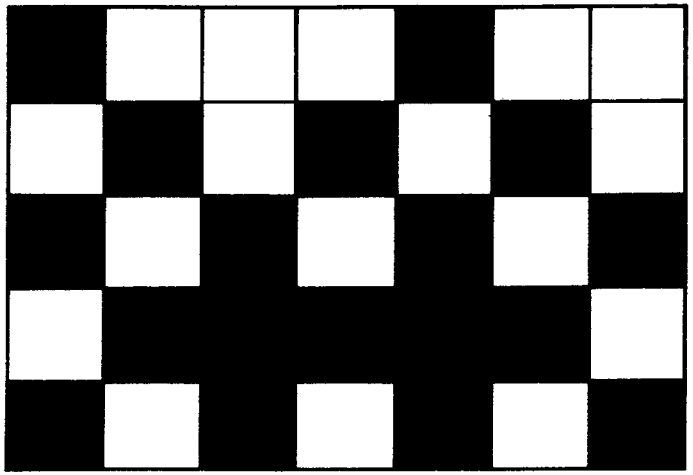

For example, when the image data shown in FIG. 16A is subjected to a combined process of that shown in FIGS. 13A and 13B and that shown in FIGS. 16A, 16B and 16C, the image data shown in FIG. 18A can be obtained, which produces an image shown in FIG. 18B.

Figure 12A:
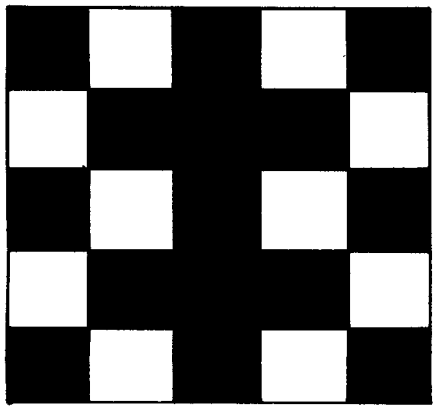
FIGS. 12A and 12B illustrate an example of image data restructuring in accordance with the embodiment.
Figure 12B:
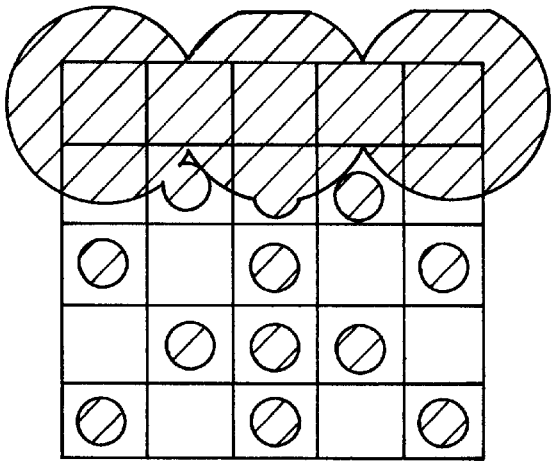
Figure 15B:
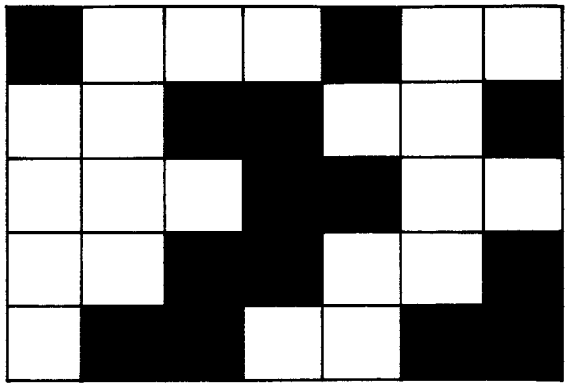
FIGS. 15A through 15C illustrate an exemplary way of image data restructuring.
Figure 15A:
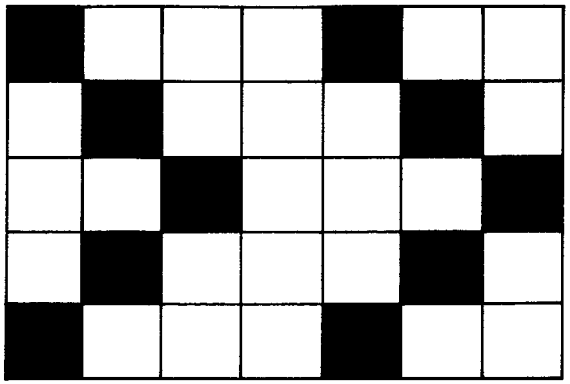
Figure 15C:
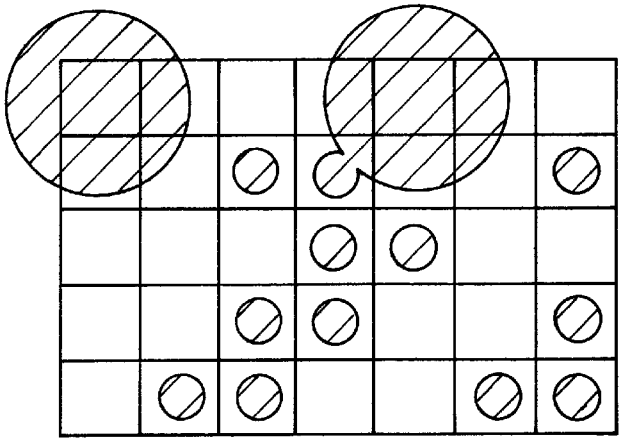
Figure 17B:
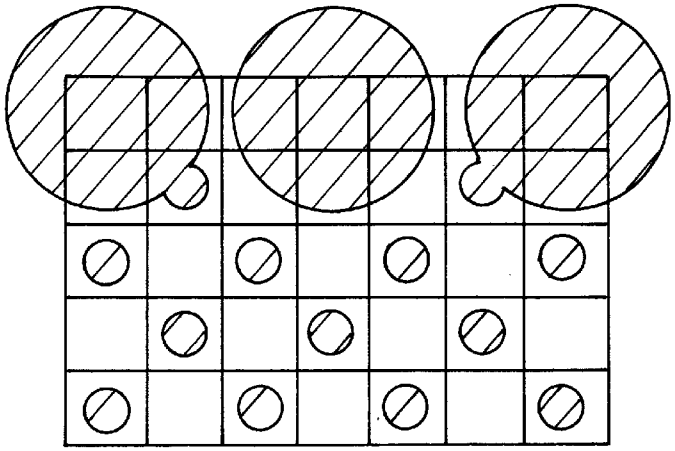
FIGS. 17A through 17C illustrate an example showing a way of image data restructuring.
Figure 17A:
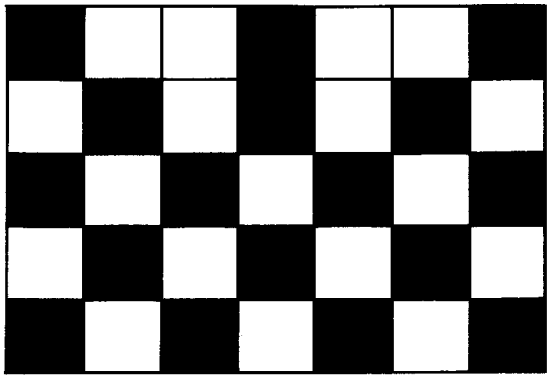
Figure 17C:
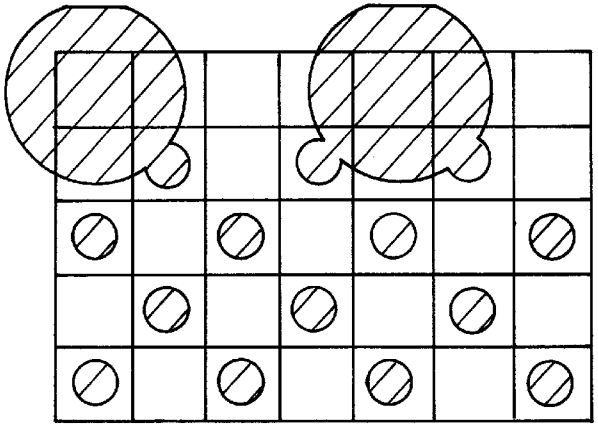

The way of combining multiple processes should not be limited to that shown in FIGS. 18A and 18B, various kinds of combination are allowed such as the combination of that shown in FIGS. 12A and 12B and that shown in FIGS. 13A and 13B, the combination of that shown in FIGS. 14A and 14B, that shown in FIGS. 15A, 15B and 15C and that shown in FIGS. 17A, 17B and 17C, etc.

The above example referred to the case where the density of halftone is lowered due to second type toner transfer. However, there are cases where a printing pattern does not contain so many dots of second type toner transfer. In such a case, the density and size of dots of the first type increase, becoming more than needed, making the density of the half tone excessively high.

Figure 19B:
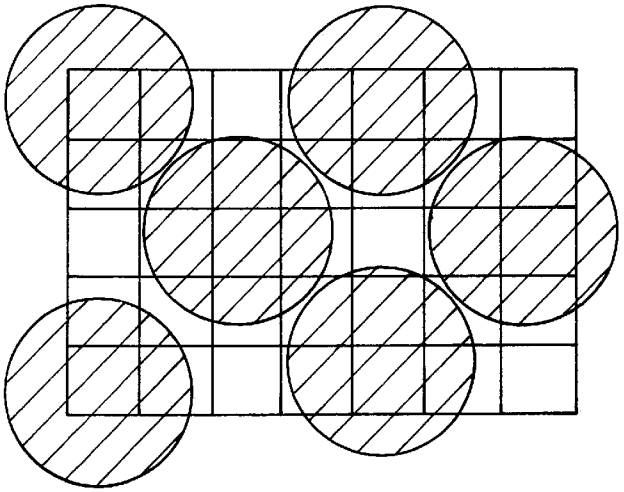
FIGS. 19A through 19D illustrate an example showing a way of image data restructuring.
Figure 19D:
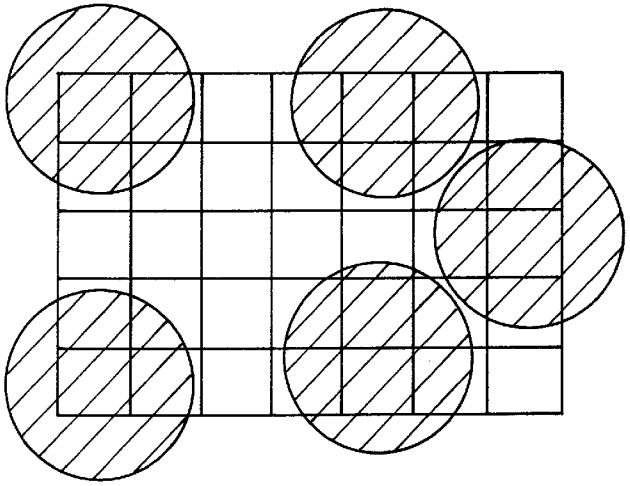
Figure 19A:
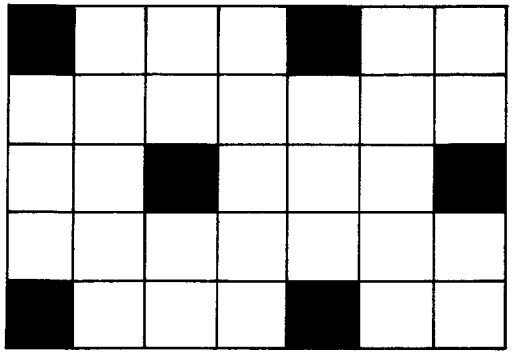

For example, suppose, in the case of the image data shown in FIG. 19A, all the dots are obtained as those of the first type. If so, the actually obtained image will have dots that are excessively large as shown in FIG. 19B. Therefore, in such a case, it is necessary to effect a process opposite to that shown above. For example, some of dots may be thinned, or the gap between dots may be broadened, and/or the positions of the pixels of data may be shifted deliberately so as to cause second type toner transfer.

Figure 19C:
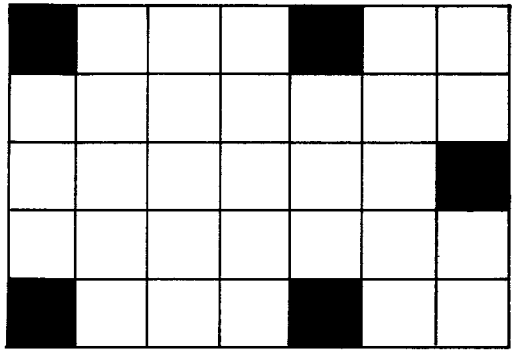

This will be illustratively described with reference to FIGS. 19A, 19B, 19C and 19D. Here, FIG. 19C is the image data obtained after thinning dots from the image data shown in FIG. 19A. Suppose that all the pixels of data shown in FIGS. 1A and 11B are reproduced as the dots of first type toner transfer, all the dots tend to be large, so that the image actually obtained will be that shown in FIG. 19B. Accordingly, in this case, it is better to restructure the image data into a thinned form, as shown in FIG. 19C. The actually obtained image is as shown in FIG. 19D, which presents the desired image density.

Next, the restructuring procedures of the above image data will be described specifically with reference to FIG. 20.

First, an obtained piece of image data is used to create a virtual image in memory while ideal dot size and density previously stored are loaded (Step 201). From these data, the image density to be obtained is calculated. The image density in this case might be determined using a well-known filtering process, or may be calculated using an area dividing technique. Simply, the image density which will be obtained when ideal dots are formed in positions where they should be formed is calculated and the result is stored as ID0 (Step 202). For example, suppose that the image data (A) obtained is that shown in FIG. 11A, the destiny of the image when ideal dots are formed, that is, the density of the image shown in FIG. 11B, is determined by computation. In this case, the ideal dot size and dot density need to have been stored previously, and these values are used to calculate the image density when the image shown in FIG. 11B is formed, and the result is set as ID0.

Next, the type, i.e., the first, second or third type of toner transfer, of the dots which will be obtained when this image is printed by the image forming apparatus, is determined (Step S203). Then, the image to be obtained from these dots of first, second and third toner transfer types, is formed in a similar manner in memory; that is, that image shown in FIG. 8 is constructed in memory, and the density is calculated from this image and stored as ID1 (Step 205). In this case, the size and density of the dots obtained by the first, second and third types of toner transfer need to have been determined previously from experiments etc., and stored. By loading these data (Step 204), ID1 is calculated.

Next, the above ID0 and ID1 are compared (Step 206). If ID0 is equal to ID1 or falls within the predetermined permissible range, the obtained image data (A) is used as is for printing (Step 207). On the contrary, when ID1 deviates from ID0 beyond the permissible range, the image data (A) is restructured based on the above various methods, to form the image data (B) (Step 208). In the above discussion, as an example, the image data shown in FIG. 11A is restructured into the image data shown in FIG. 12A. The restructured image data (B) is again generated in memory. For example, the image shown in FIG. 12B is produced in memory, and is evaluated taking into account the first, second and third types of toner transfer in a similar manner as above (Step 209), to calculate the image density, ID2 (Step 210). This ID2 is then compared to ID0 (Step 211). If ID2 falls within the predetermined permissible range of ID0, the restructured image data (B) is used for actual printing (Step 212).

On the other hand, when ID2 deviates from ID0 beyond the permissible range, the image data is converted again in a similar manner to reconstruct the image data (C). The image density of this is set as ID3, and compared to ID0. If ID3 falls within the predetermined permissible range of ID0, the image data (C) is used for actual printing. Further, when ID3 deviates from ID0 beyond the permissible range, the above procedures (Steps 208 to 211) are repeated to restructure the image data until image data having the designated image density is obtained.

Figure 20:
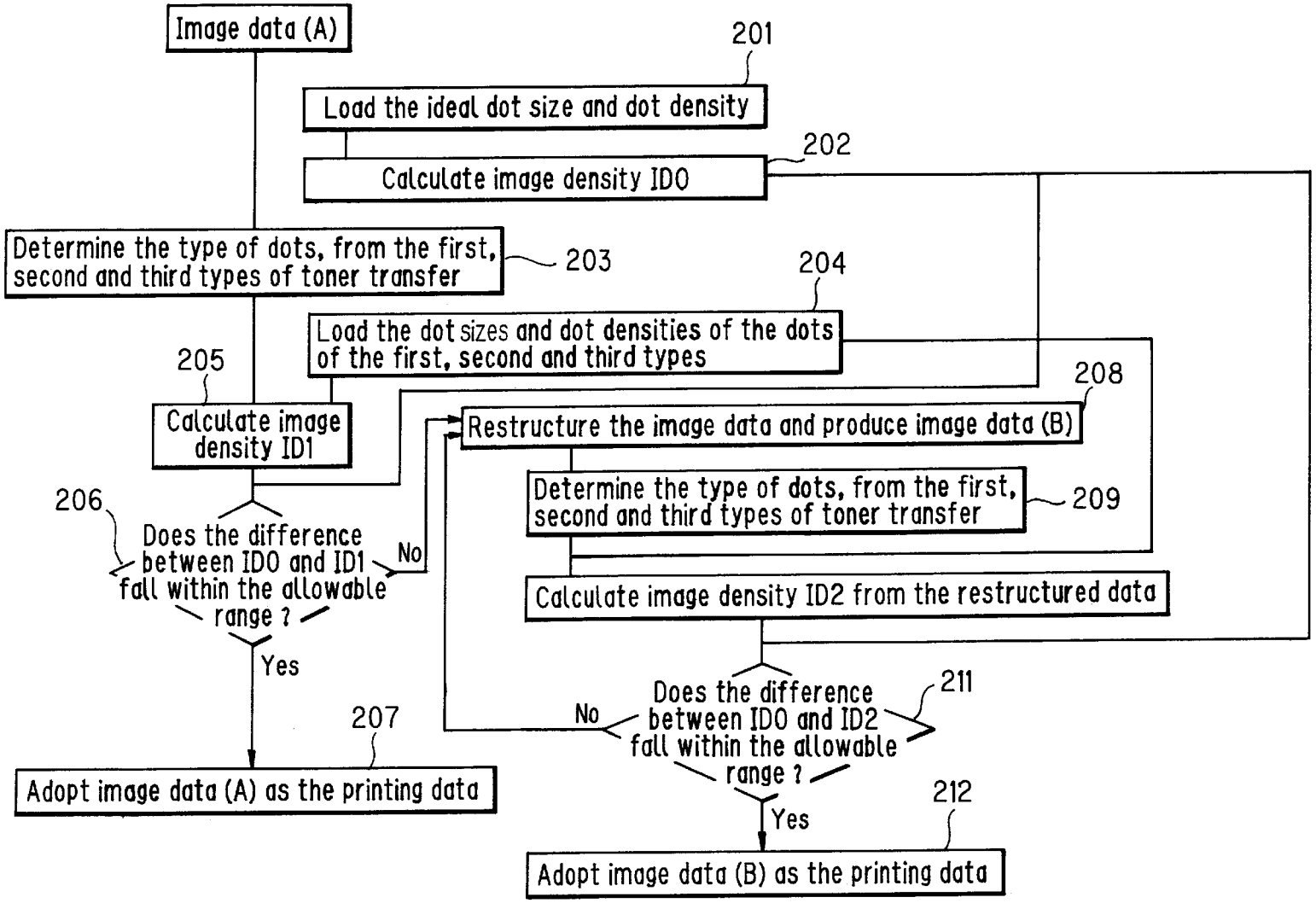
FIG. 20 is a flowchart for illustrating a way of image data restructuring.

In the flowchart shown in FIG. 20, there is a step in which the image data (C) is redefined as the image data (B), but the invention should not be limited to this. The permissible range of the density difference may be set as appropriate depending upon the specifications of the machine. In the foregoing description, the restructuring of the image data was explained using the work flow for the case shown in FIGS. 12A and 12B, but the invention should not be limited to this, and the restructuring can be performed by various ways and combinations of the above method.

Figure 10:
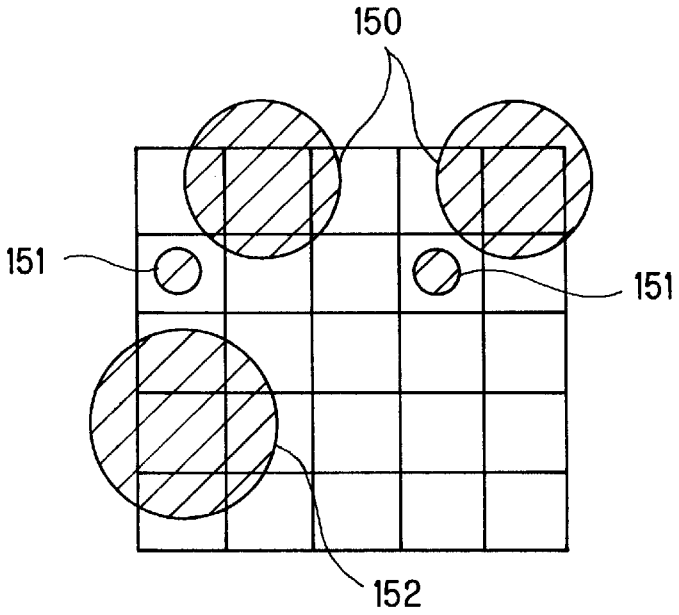
FIG. 10 is an illustration showing an example of a halftone image.

In the above explanation, the case as shown in FIG. 10 was exemplified in which dot 151 adjacent to dot 150 of the first type is of the second type. Similarly, the cases shown in FIGS. 10 through 19D are merely examples for explaining the countermeasures against ununiformity of dots produced by first, second and third type toner transfer. For example, the configuration of the control electrode 26 is not limited to that shown in FIG. 3 but can be provided in a diverse form depending upon the configuration and control of the apparatus. However, the positions of dots to be generated by second type toner transfer are subject to change depending upon the position of gate 29 provided on control electrode 26, the speed of movement of toner support 22 and the process speed, so that this is limited by the configuration of the apparatus alone. In other words, only after these factors have been determined, or depending upon the characteristics of the image forming apparatus, the position at which second type toner transfer occurs will become obvious for any image data, hence it becomes possible to predict where the density lowers and where white lines appear. As a result, the restructuring method of image data may be modified as appropriate so as to make a good compensation for image degradation due to the second type toner transfer. This can be made, for example, by determining the positions for complementation of dots, based on the characteristics of the image formation position.

Moreover, in the above embodiment, complementing and thinning methods of dots of first, second and third type toner transfer were detailed, but a suitable method may be selected from these depending upon the image to be printed. For such a process, dots of first, second and third toner transfer may be positively used to restructure the image data. As has been already described, the size and density of these dots have variations, so that these can be effectively made the best use of to restructure the image data.

For example, the dot obtained by second type toner transfer has a small dot size and a low dot density, so that it is possible to finely adjust the density when complementation is made with dots of the second type. Thus, a fine density control can be performed, making it possible to achieve a more exact reproduction of density. When dots obtained by first type toner transfer are used for complementation, a single dot of the first type can effectively produce complementation because the dot size and dot density is high in this case. This can inhibit extreme increases in the amount of image data. Further, when the positions of dots are shifted, concentration of dots can be prevented so as not to form high or low density areas, thus making it possible to form a good image.

Inversely, there is a case where the original image data has areas partially high or low in density but this would be lost by formation using the first, second and third types of toner transfer. In this case the image data can be restructured closer to the original image data by deliberately producing areas locally high or low in density.

Further, it is possible to restructure more efficient image data with an unvaried amount of image data by shifting the positions of dots and/or thinning the dots etc., or more specifically by replacing dots of the second type with dots of the first type.

Figure 21A:
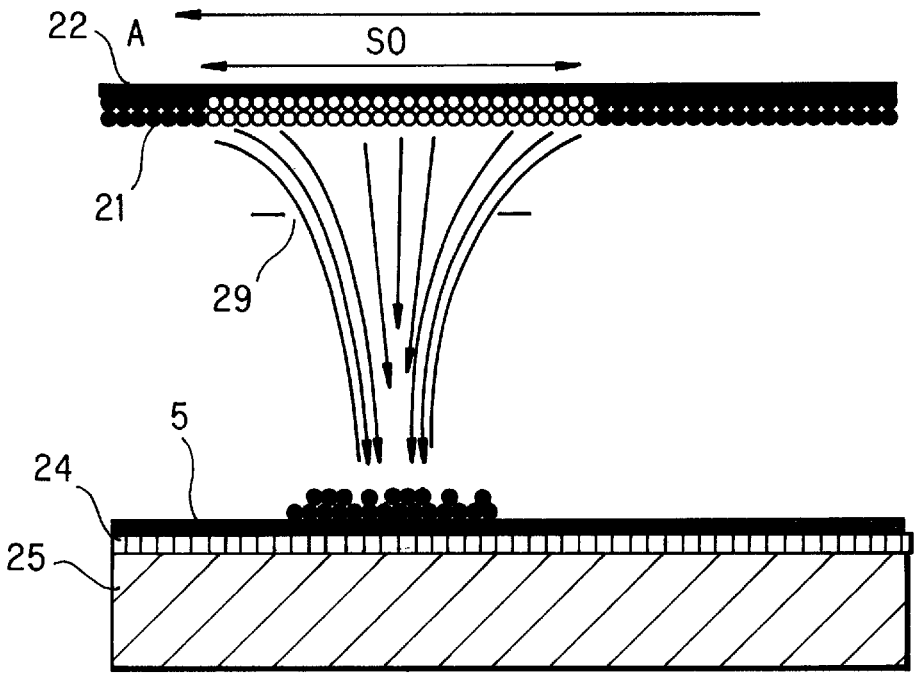
FIGS. 21A and 21B are illustrations showing another example of a toner jumping state.
Figure 21B:
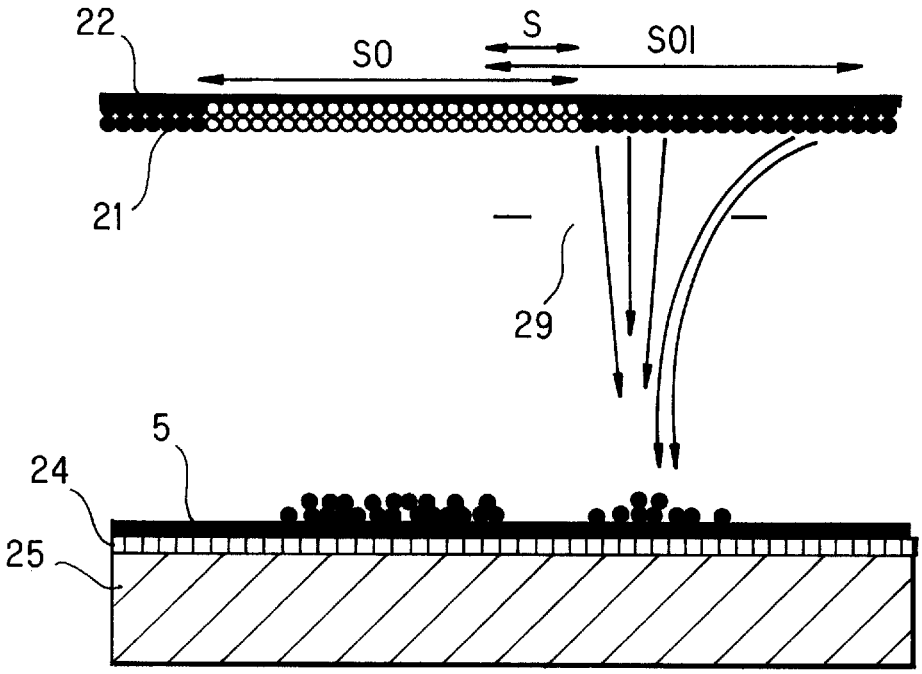

The above description was made based on the case where second type toner transfer is obtained by the combination of a gate 29 and another gate adjacent to gate 29. There is a case in which, toner 21 repeatedly passes through a single gate 29 as shown in FIGS. 21A and 21B. In this case, the aforementioned second type toner transfer will occur for an identical gate 29. In FIGS. 21A and 21B, toner support 22 is moving in the direction of arrow A in the figures.

Figure 22B:
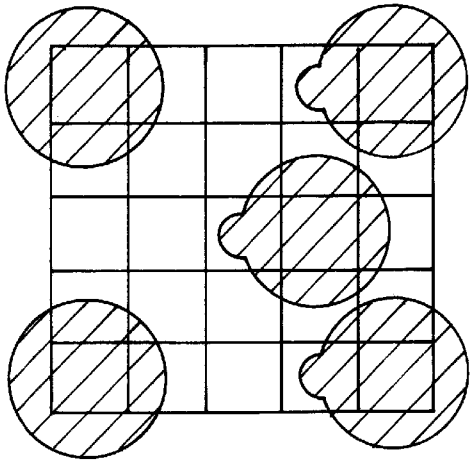
FIGS. 22A through 22D illustrates an exemplary way of image data restructuring.

As shown in FIG. 21A, when toner 21 jumps from gate 29 (when first type toner transfer occurs), an area S0 with no toner 21 forms on tone support 22 as already described. If another jumping of toner 21 is caused to occur again for the same gate 29, there is a case in which the two jumping events have a positional relationship as shown in FIG. 21B because area S0 might not have completely cleared the position of gate 29 at time the second jumping occurs. Accordingly, if another jumping of toner 21 is activated under these conditions, toner transfer of the second type occurs. Further, if this is repeated, transfer of the third type also easily occurs. Therefore, when a print is formed from the image data shown in FIG. 22A, under these conditions, the resulting image will be that as shown in FIG. 22B, which is not the desired one. Accordingly, it is preferable to produce an image having the designated image density using the foregoing process.

To avoid the repetition, the following description will be made only of a case where the dot adjacent to a dot formed by second type toner transfer is complemented.

Figure 22D:
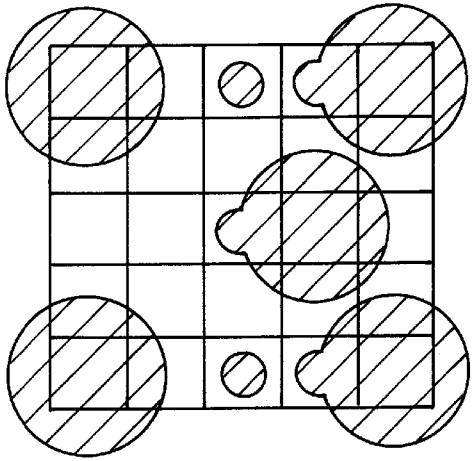
Figure 22A:
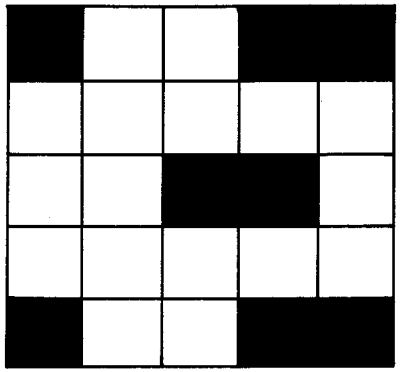
Figure 22C:
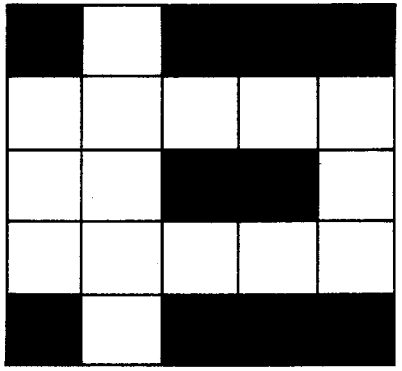

For the image data shown in FIG. 22A, pixels of data can be complemented, for example, as shown in FIG. 22C. In this case, the actually obtained image will be that shown in FIG. 22D, which presents the desired image density.

In the embodiment of the invention, determination of dots of the first, second and third type toner transfer as well as determination of the image densities occurring from these toner transfers and the predetermined image densities ID0 to ID2 is performed based on calculation. The way of calculation will not be limited, but only one example will be described hereinbelow.

First, for a dot of first type toner transfer at a pixel position (xi, yj), the pixel positions (xi+n, yj+m) of dots which become a dot of second type toner transfer can easily be determined based on a previous experiment etc.

Further, the positions of dots becoming a dot of the third type can also be located. Under these conditions, dot sizes f11 and f12 of the dots of the second and third types, dot densities id1 and id2 thereof, and positions P are all known. For example, when part of image data is that shown in FIG. 23A, the mean density ID1 of the mask can be calculated as a function of these:

$$ID1=g(f11, f12, id1, id2, p).$$

Figure 23A:
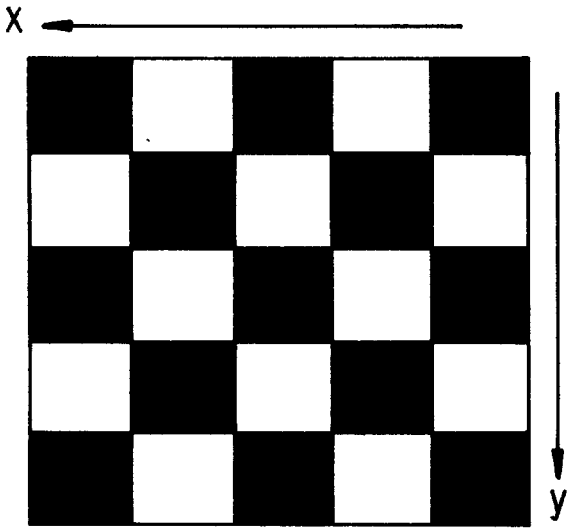
FIGS. 23A and 23E illustrate an example of a desired image used in the embodiment.

Accordingly, first, it is necessary to determine which dot, selected from the dots of the first, second and third types, each of the pixels for the image data of the 5×5 mask shown in FIG. 23A is to be formed with. For simplicity, it is assumed that the dot of the second or third type will arise at pixel position (xi+1, yj+1) with respect to the pixel position (xi,yj) of the dot of the first type, i.e., (n=m=1 in the above) and the dot of the second type and that of the third type are identical.

Figure 24:
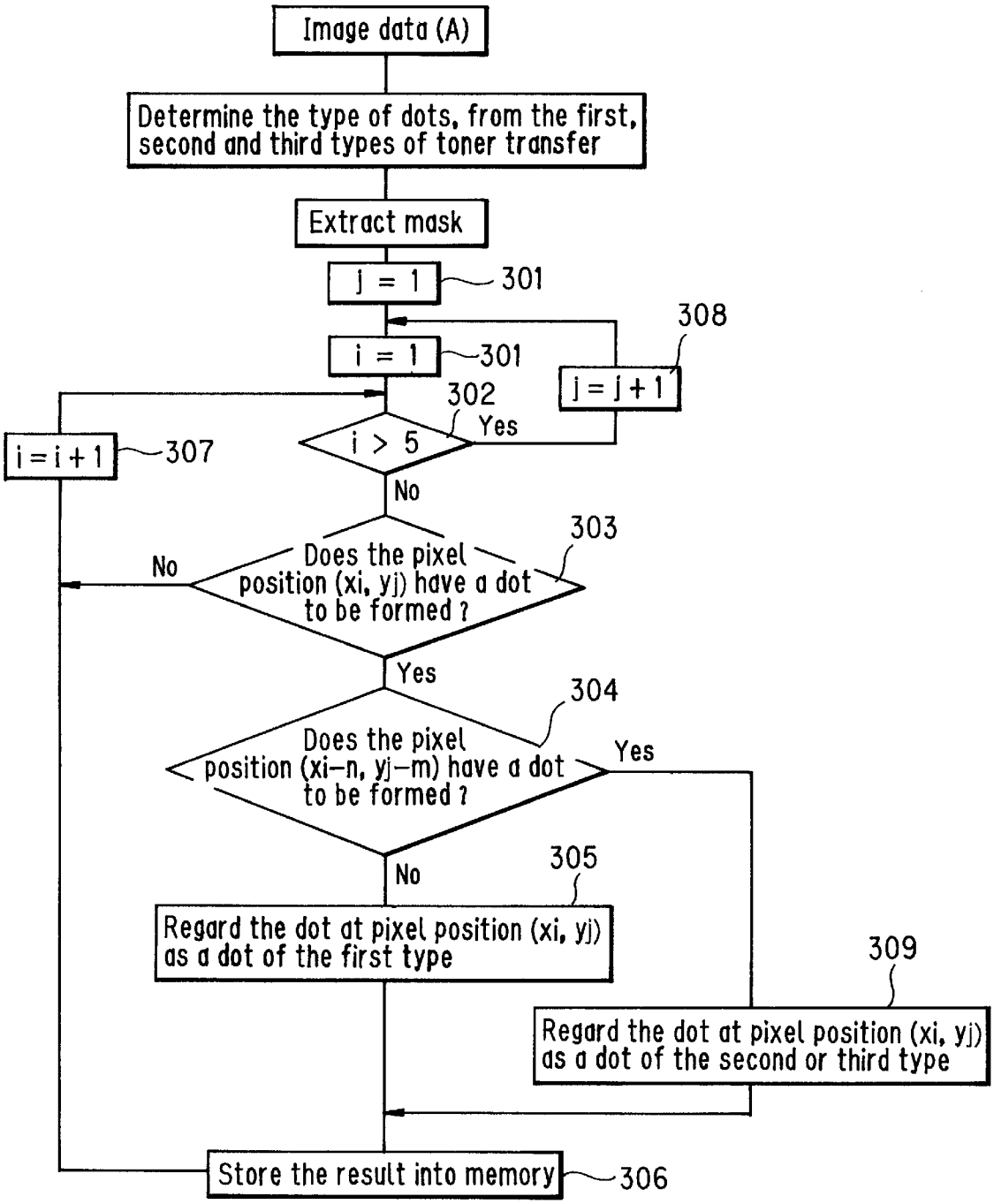
FIG. 24 is a flowchart for illustrating dot determination of the dot type.

The way of determining each dot to be of the first, second or third type is not particularly limited, but a method shown in the flowchart of FIG. 24, for example, can be used.

First, the initial value is set as i=j=1 (Step 301), then it is checked to see if i is greater than 5 (i>5) (Step 302). Unless i>5, checking of whether the pixel position (x1,y1) has a dot to be written therein (step 303) is performed.

In FIG. 23A, printing is performed in the direction of arrow x in the figure. It is checked to see whether the pixel position (x0,y0) has a dot to be written therein (Step 304). In this case, assuming no dot is formed at the pixel position (x0, y0), the dot at pixel position (x1,y1) can be regarded as a dot of the first type (Step 305) and this information is put into memory (Step 306).

Next, i is increased by increment of 1 so that i=2 (Step 307), and it is judged whether printing is to be performed (Step 303). In this case, no printing occurs at the pixel position (x2,y1), so that i is set to be 3 (i=3) (Step 307). Since i is not greater than 5 (i>5) (Step 302), checking for a dot is performed (Step 303).

In a similar manner, it is checked if printing is to be performed up to i=5, then i becomes equal to 6 (i=6) at Step 307. Therefore i is determined to be grater than 5 (i>5) (Step 302). Then, j is increased by increment of 1 so that j=2 (Step 308). Again it is judged whether printing is to be performed.

If printing is performed at the pixel position (xi−1,yj−1) at step 304, the dot at the pixel position (xi,yj) is determined to be that of the second or the third type (Step 309), and this information is stored into memory at step 306.

In this embodiment in FIG. 24, it is assumed that if there is a dot at pixel position (xi,yj), the dot at pixel position (xi+n,yj+m) will be of the second or third type. That is, the flow of this embodiment shown in FIG. 24 judges whether there is any dot at the pixel position (xi−n,yj−m) in order to determine which dot type, the first, second or third type, the dot at pixel position (xi,yj) belongs to. The above series of procedures are repeated so that it is possible to easily determine which type each of the dots belongs to.

Figure 23B:
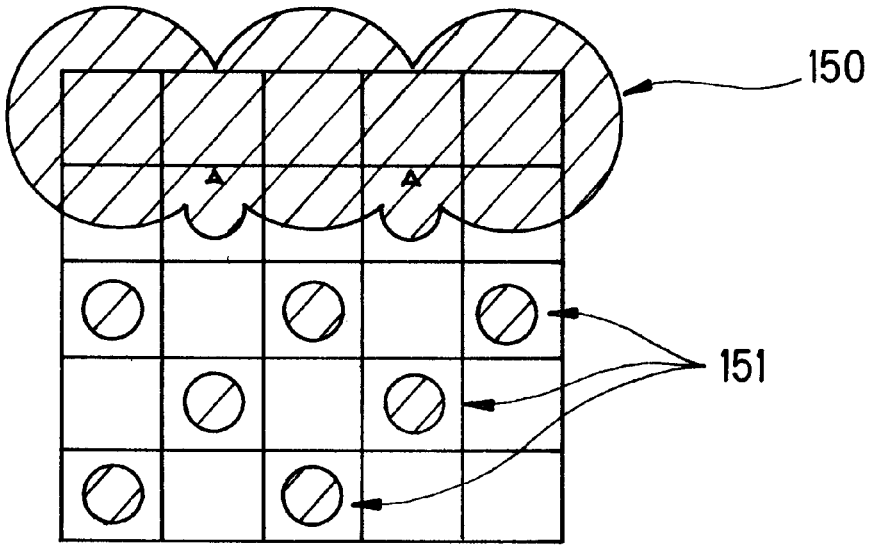

Further, based on these judgments, it is possible to predict how the image will appear when printed, in a manner such that when the image data shown in FIG. 23A is used for printing, the image shown in FIG. 23B will appear as a printed image. Thus, it is possible to determine the density of this mask, in particular, the mean density ID1 of the mask shown in FIGS. 23A and 23B, based on the above formula. In FIG. 23B, reference numeral 150 designates a dot of the first type, 151 designates a dot of the second or third type. The aforementioned function g, and m and n vary depending upon the machine's properties, the shape of the formed dot, the properties of toner 21 to be used, and the like so that they cannot be determined uniquely, but they can be determined as appropriate in accordance with these properties. Further, in FIGS. 23A and 23B, a mask of 5×5 pixels was used but the mask should not be limited to this, any mask can be selected so as to restructure a good image.

Thus, in accordance with this embodiment, when the deviation of the density of an actually printed image from the image density to be obtained from the image data can be anticipated previously, from potentially involved problems of the apparatus, the image data in the areas where density deviation may occur is subjected to data restructuring processing such as complementing, thinning and the like, to restructure the image data. Accordingly, a high quality image can be obtained without the necessity of extra parts, increase in the size and cost of the apparatus and degradation of the reliability, all of which are problems in conventional configurations.

Figure 25:
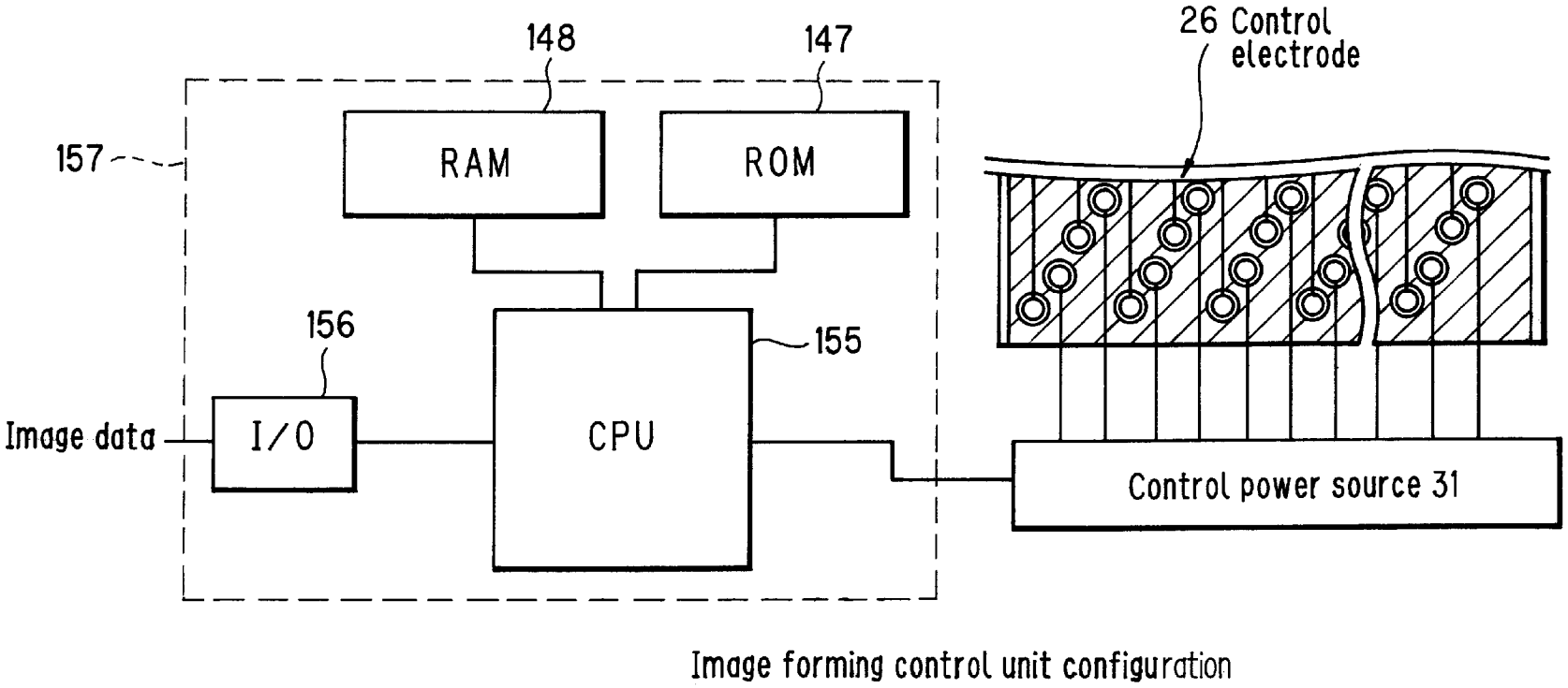
FIG. 25 is a diagram showing a configuration of an image forming control unit.

Further, in the image forming apparatus of the invention, for example, as shown in FIG. 25, the restructuring of image data is performed in an image formation processing unit 157 provided in the image forming apparatus. This image formation processing unit 157 comprises: an I/O 156 as the input means of image data; ROM 147 for storing the image processing program, the dot sizes, dot densities and dot shapes of the dots formed by first, second and third toner transfer, and the computing method of computing the image density from these data; RAM 148 for temporarily storing the image data, the determined result of the type, i.e., the first, second or third type, of all the dots; and a CPU 155 for performing computation concerning the image processing and the density. The data after restructuring is further converted into the control-electrode controlling signal, and is transmitted to control power source 31 where the signal is further converted into the application voltage to be applied to each of the electrodes of control electrode 26.

Few problems will occur when the image forming apparatus of this embodiment is applied to upper-level models for office use, for example. However, if the apparatus is required to be considerably inexpensive for personal use, it is of no advantage to effect the above image processing within the image forming apparatus. This image processing is extremely complicated, needing extremely large storage for ROM 147 and RAM 148 required for the processing. So in some embodiments, multiple number of ROMs and RAMs may be needed. Also CPU 155 which performs actual processing, needs to operate at extremely high speed.

So that, if this image forming apparatus is used as the output device of a computer or word processor having a high processing speed, the system can be configured so that the above image processing is executed inside the computer or word processor and the restructured image data is transferred to the image forming apparatus, so as to avoid the above complicated process being performed within the image forming apparatus.

Restructuring of image data as above may need very fast processing speed and mass storage for processing certain contents. Therefore, it is reasonable that the image data be restructured by the computer which can operate at a high speed and has a sufficiently large capacity storage, compared to providing a complicated image processing means within the image forming apparatus. In this case, ROM 147 and RAM 148 required for the above image processing become unnecessary or can be markedly simplified, so that it is possible to reduce the number of parts and hence reduce the size and cost of the apparatus as well as improve the reliability.

When the above image forming apparatus is the output means of a computer or word processor, and the computer or word processor has no means of restructuring the above image data, the program as well as the data etc. required for restructuring the image data may be installed through recording media such as floppy discs, CD-ROM, MO discs etc., into the computer or word processor so that the host can implement the invention. In this way, it is possible for such a host to achieve satisfactory image formation. Further, it is possible to transfer the image processing program and data of the invention to an image forming apparatus which originally has no image forming means for restructuring the above image data, via a computer or word processor.

Figure 26A:
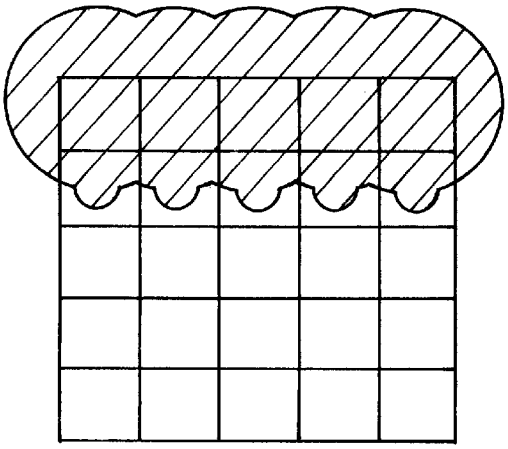
FIGS. 26A through 26D illustrates an exemplary way of image data restructuring.
Figure 26B:
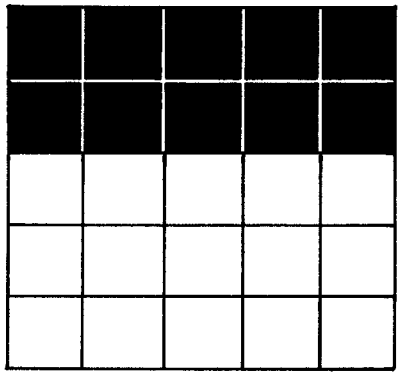
Figure 26C:
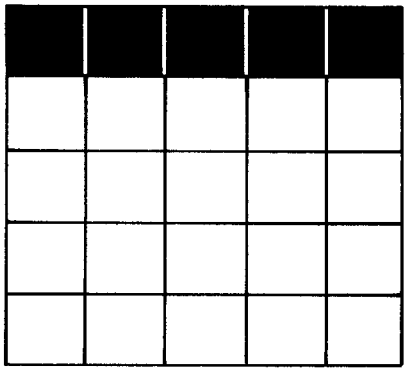
Figure 26D:
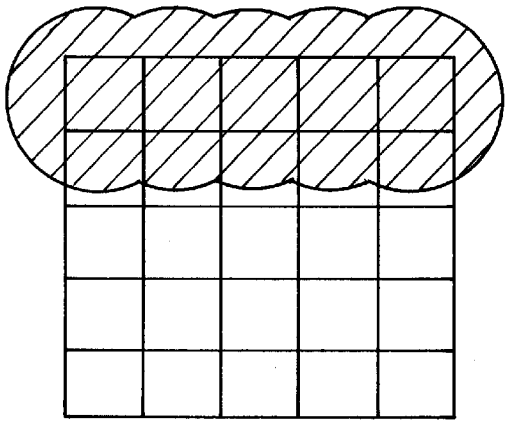

In the present invention, when the image data is restructured, it is possible to separate the total data of an image into individual areas so that each area can be processed in a suitable manner. For example, in the above explanation, reproduction of halftones of halftone dot images was mainly discussed. However, for the case of text or character areas, for example, if second and/or third toner transfer arise when reproducing the edges of characters, small-diametric dots are formed at the edges of characters as shown in FIG. 26A, resulting in an image with its contours blurred and lacking contrast. If the image data shown in FIG. 26B is thinned by omitting the pixels of data at the edge causing toner transfer of the second type so as to form the image data as shown in FIG. 26C, no small-diametric dots will be formed as the edge shown in FIG. 26D, thus making it possible to produce a sufficiently clear image with contrasting contours.

Figure 27A:
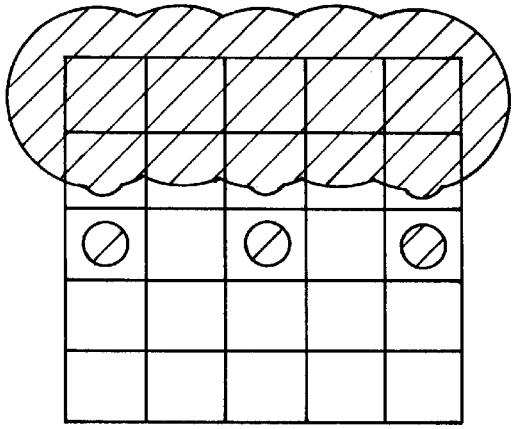
FIGS. 27A through 27D illustrates an exemplary way of image data restructuring.
Figure 27B:
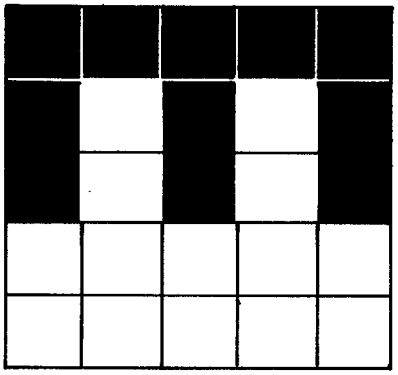
Figure 27C:
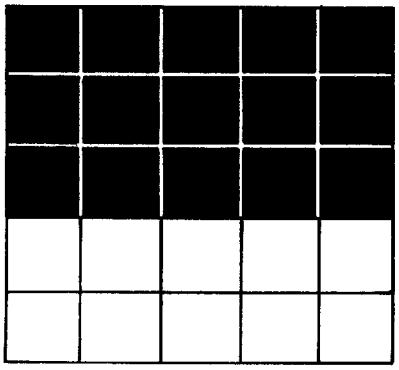
Figure 27D:
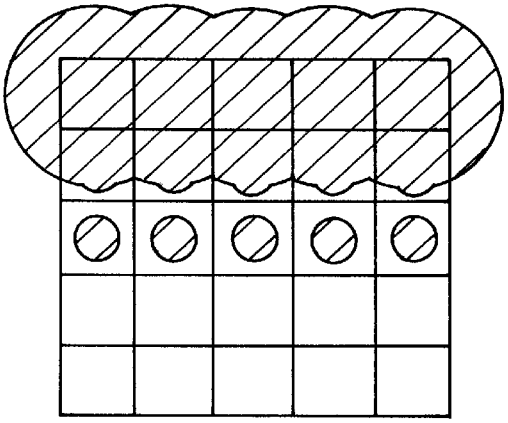

Conversely, when an image shown in FIG. 27A is produced from the image data shown in FIG. 27B, the image data is complemented with pixels as shown in FIG. 27C to produce an image shown in FIG. 27D. In this way, it is possible to alleviate the reduction of contrast. In the case of the image forming apparatus of this embodiment where toner support 22 has a curvature relative to the control electrode, the distance between each gate 29 and toner support 22 is not uniform. Since, in an apparatus of this type, the dot size and dot density of the dots formed on paper 5 vary, the apparatus suffers from halftone reproduction problems, etc. The present invention can also be applied readily to this case.

Figure 28:
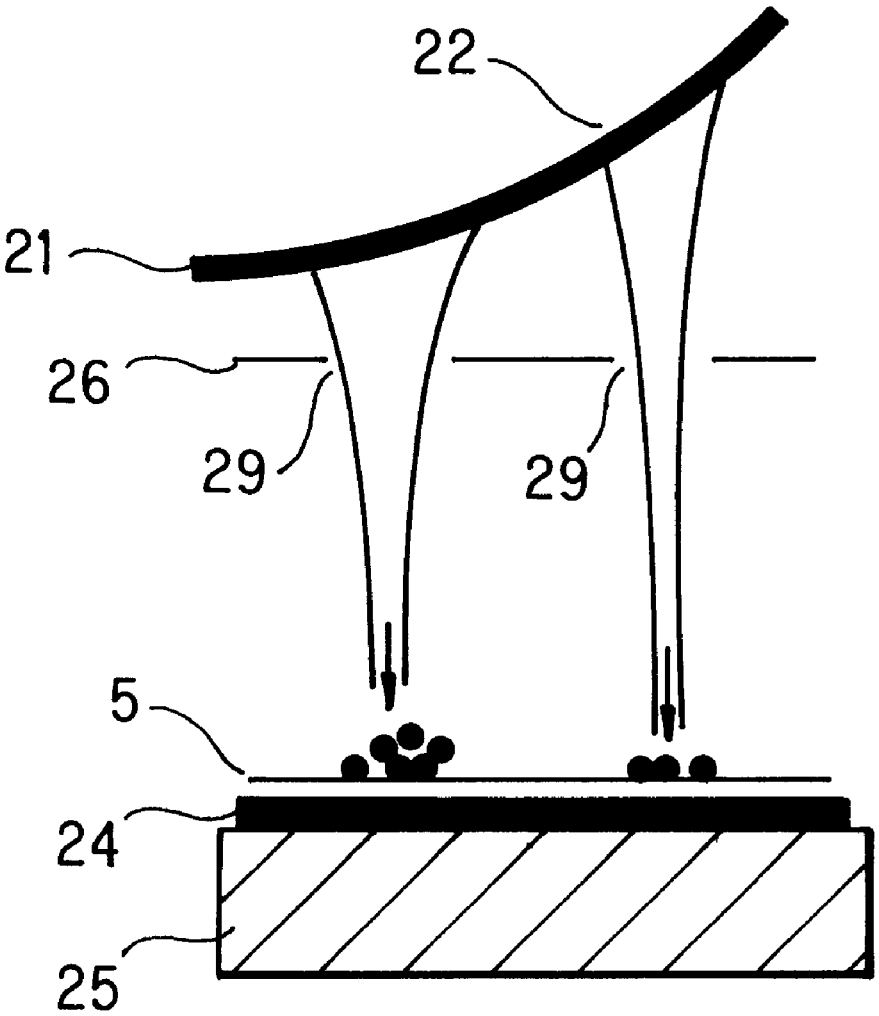
FIG. 28 is an illustration showing another example of a toner jumping state.

For example, since the distance from the gate 29 located in an area offset from the center of toner support 22 is greater than the gate 29 in the center as shown in FIG. 28, the electric field in the offset area is weak so that a lower amount of toner 21 passes through the gate 29 in the offset area. In this case, the dot formed on paper 5 of the toner passing through the gate in the offset area presents insufficiencies in its size and density as shown in FIG. 28, or is smaller in diameter and lower in dot density than that formed through the gate 29 in the center.

In this case, similar problems arise to those that arise due to ununiformity of the dot size and dot density, that is, the lowering of the image density arising when the dot size reduced and the density are lowered because of second type toner transfer and image degradation such as occurrence of striping because of dots obtained through toner transfer of first, second and third types.

Also in this case, similar to the above case already disclosed, it is possible to exactly predict the areas in which the density would lower due to small-sized dots, the areas in which the density would, conversely, become high, and the amount of their variations. Therefore, by restructuring the image data for these areas by addition, thinning and/or shifting of dots, etc., it is possible to obtain the desired image density. Again, in the above embodiment, cases were discussed where variations in dot size and dot density occur due to first and second type toner transfer. However, variations in the dot size and dot density could occur for other reasons than due to first, second and third type toner transfer. That is, this phenomenon can occur in the case shown in FIGS. 27A to 27D or due to other reasons. Accordingly, for these cases, it is possible to successfully apply the restructuring process of image data, taking into account dots of toner transfer of the first, second and third types. For example, in the case shown in FIGS. 27A to 27D, if the size and density of a dot at the edge and those of a dot at the center were previously checked and stored in memory, it is possible to restructure the image data by using the aforementioned various types of processings.

Further, when first, second and third toner transfer occurs under the conditions shown in FIG. 28, it is preferred to restructure the image data by using the aforementioned various types of processing so as to provide for the desired image density. Moreover, when some trouble has occurred like image density being lowered or heightened due to continuous printing, it is possible to compensate for this situation by restructuring the image data using information, which has been previously stored, of the variations in dot size and dot density occurring from continuous printing or the like.

Further, there is a case where the dot density varies depending on the change of the usage environment, for example, under the conditions of a high-temperature, high-humidity environment. To deal with this case, the system may be configured so that the variations in dot size and dot density under high-temperature, high-humidity environments are adapted to have been checked previously and stored into memory and the image data can be restructured using it when this case occurs. In this case configured so that toner transfer of the first, second and third types occurs, the most preferable configuration is one where the image data is subjected to the aforementioned various types of processing using the information which has been previously stored, of the variations for each transfer type dot due to change of usage environment and due to continuous printing.

It is also preferable to use the data of the variations in dot size and dot density with the passage of time. As an example, it is possible to handle the case where the dot size and dot density differ between a dot in the offset area and that at the center, by following a similar work flow to that shown in FIG. 20, where steps 203 to 205 are replaced with the work flow shown in FIG. 29, taking into account the conditions connected to this case.

Figure 29:
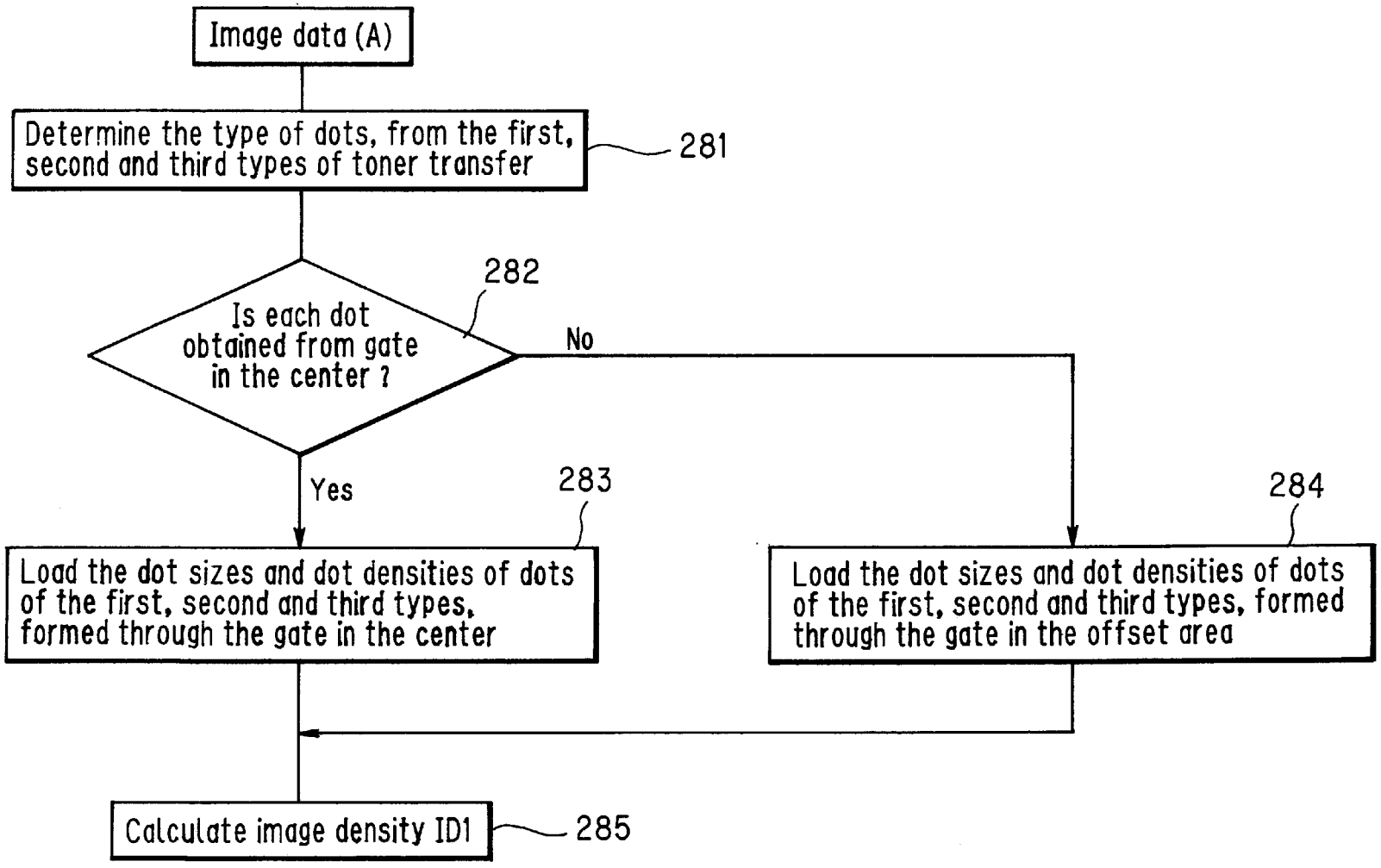
FIG. 29 is a flowchart for illustrating a way of image data restructuring.

Referring to the work flow shown in FIG. 29, first, the type, i.e., first, second or third type of toner transfer is determined (Step S281). Then, it is judged whether each dot is obtained from gate 29 in the offset area or is obtained from gate 29 located at the center (Step 282). Then image density ID1 is calculated in accordance with the properties of each dot previously stored in memory. More specifically, the dot sizes and dot densities of dots formed through gate 29 in the offset area, by toner transfer of the first, second and third types, and the dot sizes and dot densities of dots formed through gate 29 at the center, by toner transfer of the first, second and third types, are read out (Step 283 and 284) so as to calculate image density ID1 (Step 285). In this case, steps 208 to 210 of the flowchart shown in FIG. 20 should be modified appropriately so as to meet the work flow of FIG. 29.

Also, when the dot size and dot density vary depending on a life, i.e., aging conditions, usage environment, conditions of printing operation and the like, the flowchart shown in FIG. 20 can be appropriately modified in part, into a work flow similar to that shown in FIG. 29, for example. Description of examples of these processings will be omitted to avoid repetition with the above description.

In the description of this embodiment, the positions of gates 29 are divided into two parts, i.e., the centered part and offset part, with reference to FIGS. 28 and 29. However, it is also possible to restructure the image data, by taking into account the dot size and dot density of gates 29 located halfway between the centered part and the offset part. Moreover, it is possible to restructure the image data, by using dot sizes and dot densities of gates 29 belonging to further divided, narrow areas.

In the description of this embodiment, the restructuring of the image data was performed taking into account only the image density. However, the invention is not limited to the image density. For example, the image data may also be restructured by taking into account, for example, sharpness, blur, raggedness, or a plurality of image-quality indicators, so as to produce the best quality of image.

In the above description, it was assumed that the dot obtained by second type toner transfer and that obtained by the third type are almost the same. When the dot of the second type and the of the third type have different shapes from each other, the processing contents may be modified appropriately in accordance with the conditions.

In the above description of the embodiment, a single drive control was explained wherein jumping of toner 21 through gates 29 is controlled by individual electrodes for each gate 29. The present invention, however, can be applied in the same manner to the case where a control electrode 26 having a matrix control configuration as shown in FIG. 30 is used, so as to form excellent images.

Figure 30:
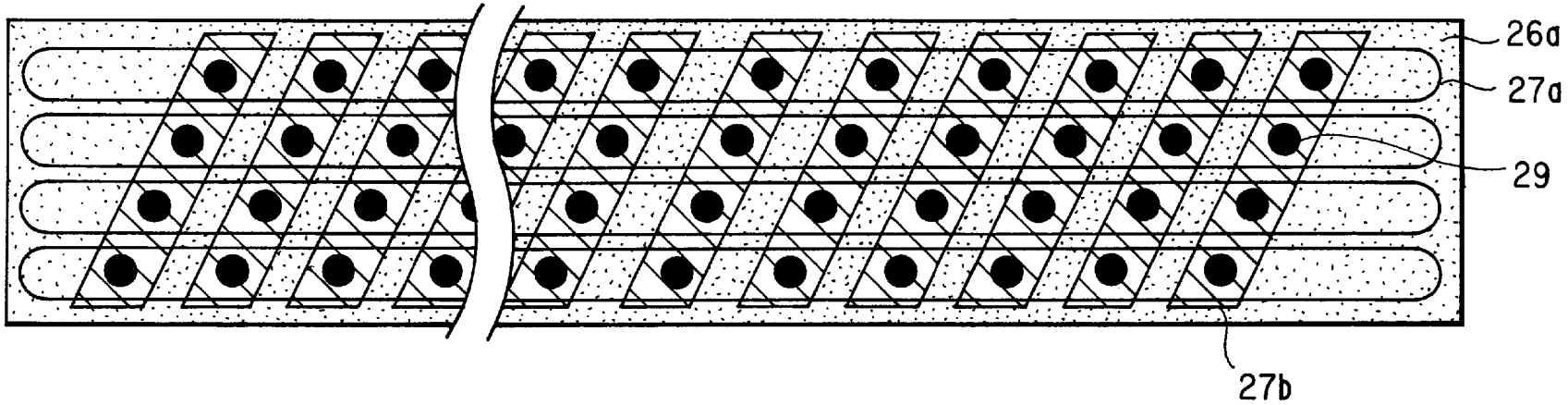
FIG. 30 is view showing another form of a control electrode.

In this configuration shown in FIG. 30, in place of annular electrodes 27, strip-like electrodes 27*a* and 27*b* are provided. More specifically, strip-like electrodes 27*b* are provided on the side of control electrode 26 opposite the toner support 22 and strip-like electrodes 27*a* are provided on the side facing the opposing electrode 25.

When four-row matrix drive control is performed using control electrode 26 shown in FIG. 30, the number of FETs required can be reduced to one-fourth the number of FETs of control electrode 26 shown in FIG. 3, so that this configuration is markedly effective in the area of cost reduction. When the number of FETs to be used is further reduced to half, or to one-eighth of that of the control electrode 26 shown in FIG. 3, eight strip-like electrodes 27*a* are needed and eight gates 29 need to be provided for each strip-like electrode 27*b*. As a result of this, dots of the second and third types are caused to occur more frequently. Therefore, dot behavior due to the geometry shown in FIG. 28 is emphasized more so that the dot size and dot density of dots differ by a greater amount between a dot in the offset area and that at the center. Thus, the present invention is very effective in dealing with such a configuration.

The problems that have been recognized conventionally, arise not only in the case of a monochrome image forming apparatus, but also occur markedly in the case of a color image forming apparatus. A typical color image forming apparatus of this type comprises: a plurality of image forming units 1*a*, 1*b*, 1*c* and 1*d* made up of toner supplying sections 2*a*, 2*b*, 2*c* and 2*d* and printing sections 3*a*, 3*b*, 3*c* and 3*d*, where toner supplying sections 2*a*, 2*b*, 2*c* and 2*d* are filled with color toners, i.e., yellow, magenta, cyan and black, respectively, as shown in FIG. 31.

Figure 31:
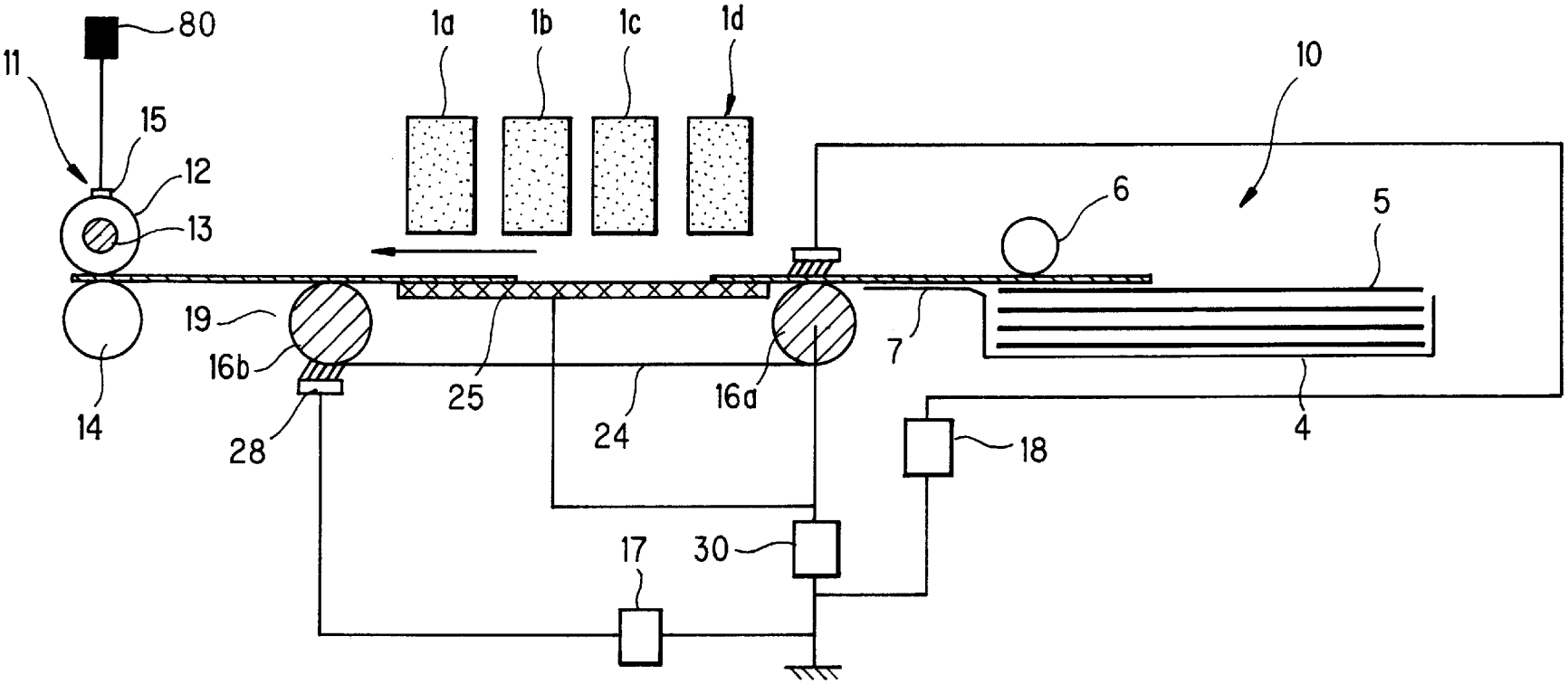
FIG. 31 is a view showing a color image forming apparatus.

In FIG. 31, image forming units 1*a*, 1*b*, 1*c* and 1*d* of the present invention are provided corresponding to yellow, magenta, cyan and black, respectively, and each color image forming unit forms a color image based on the image data of a corresponding color. Other components may be the same as shown in FIG. 2.

In the color image forming apparatus shown in FIG. 31, if dots of the second and third types arises, the desired color reproduction cannot be obtained. In accordance with the invention, the aforementioned problems will not arise, at all, high-quality color image formation with the desired color reproduction can be achieved. In this color image forming apparatus, the image data corresponding to each color of toner 21 is separately restructured. The reason for this is that the dot size and dot density of dots of the first, second and third types are different from one color of toner 21 to another.

Other than the variations in dot size and dot density of toner 21 between the offset and the centered areas as shown in FIG. 28, the variations in dot size and dot density, depending on the life, i.e., aging conditions or the usage environment, or due to continuous printing, will be different for individual colors of toner 21. Since the correction of the image density with the dot size, dot density and/or the number of dots will be different for individual colors of toner 21, the restructuring of the image data is preferably performed separately for the image data of each color. It is also possible to modify the way that data restructuring of each color of toner is done, depending upon the restructuring of the image data of other colors.

In the description of the embodiment, an example where toner is used as the developer was explained, but ink or other material can be used as the developer. It is also possible to construct toner supplying section 2 with a structure using an ion flow process so that the image forming unit may include an ion source such as corona charger or the like. Also in this case, it is possible to have the same functionality and effects as stated above. The image forming apparatus in accordance with the invention can be preferably applied to the printing unit in digital copiers and facsimile machines as well as to digital printers, plotters, etc.

As has been described in detail, in accordance with the first configuration of the invention, when the value as to a certain image-quality indicator for the first image, which is an ideal image to be formed on the recording medium surface, differs from the value as to the image-quality indicator for the second image, which is a predicated, actually formed image on the recording medium surface, by the predetermined amount, the image data is restructured so that the desired image can be obtained. Therefore, the following effects can be obtained:

1) The image degradation due to unevenness of the shape and density of formed dots can be prevented, so that it is possible to obtain a good image close to the original image to be printed.
2) Since the applied voltage for determining the printing state and/or the characteristics of the developer will not be changed, the apparatus is free from instability as well as can avoid the increase in the number of parts, increase in size and cost of the apparatus and degradation of the reliability thereof.

In accordance with the second configuration of the invention, when pixels formed by arbitrary gates of the multiple gates can be predicted to cause ununiformity, the image data to be used for printing is restructured so that the desired image can be obtained. Therefore, it is possible to obtain the image data closer to the original image data.

In accordance with the third configuration of the invention, at least, the value of the image-quality indicator belonging to the image data, the value of the image-quality indicator belonging to the printed image obtained after the image processing, and the difference in the image-quality indicator between the two are calculated, and the image data is repeatedly restructured so that the difference in the image-quality indicator between the two falls within the predetermined range. Accordingly, it is possible to obtain the image data closer to the original image data.

The fourth configuration of the invention is constructed so that restructuring of the image data is performed by at least, complementation, thinning, position-shifting of pixels, or modification of dot size and dot density by shifting the positions of pixels to be formed, or combinations of these. As a result, the following effects can be obtained:

1) Use of the restructured image data enables dots to be printed at originally printable positions.
2) Since no extra control circuit for controlling, for example, the pulse width and/or pulse timing of applied voltage pulses for printing is needed, so that it is possible to avoid the increase in the number of parts, increase in size and cost of the apparatus and degradation of the reliability thereof.

In accordance with the fifth configuration of the invention, the image forming apparatus is configured so that the control means, at least, performs control of an arbitrary gate of the multiple gates so as to cause the developer to transfer through the gate in three different ways: the first type transfer in which the passage of the developer through the gate will not be affected by the previous passage of the developer through the gate; the second type transfer which occurs after the developer transfer of the first type and in which the passage of the developer is affected by the first type transfer; and the third type transfer which occurs after the developer transfer of the first and second types and in which the passage of the developer is affected by the second type transfer, and the control means further comprises an image processing means for restructuring the image data so that the desired image can be formed, by taking advantage of at least one of the characteristics of the first, second and third transfer types. Therefore, it is possible to improve the variation of image process, thus making it possible to restructure the image data to form improved one.

In accordance with the sixth configuration of the invention, the image data is restructured by at least complementing or thinning pixels of data which will be of a dot formed of toner transfer of the second or third type. Therefore, dots of the second type, which are small in dot size and low in dot density, are complemented or thinned so that it is possible to perform image data restructure in a more fine manner.

In accordance with the seventh configuration of the invention, the image data is restructured by at least complementing or thinning dots obtained by first type transfer which are large in diameter and high in dot density, it is possible to restructure the image data more efficiently.

In accordance with the eighth configuration of the invention, since the image data is restructured by shifting the positions of pixels of data, the amount of data will not increase.

The ninth configuration of the invention provides for a desirable restructure of the image data, with a minimal increase in the image data after the restructuring or with a reduced amount of data after the restructuring.

The tenth configuration of the invention provides for a more desirable restructure of the image data, since the image data is restructured by dividing the image data into areas and subjecting each of the divided area to optimal image processing.

In accordance with the eleventh configuration of the invention, even in the case of a color image forming apparatus, the image data can be restructured for each color of developer, taking into account the fact that dot sizes and dot densities of dots of the first, second and third types differ from one color of developer to another.

In accordance with the twelfth configuration of the invention, restructuring of the image data by image processing can be performed by a computer which can operate at a high speed and has a sufficiently large capacity storage. Accordingly, it is no more necessary to provide high speed ROM or ROM on the image forming apparatus side, so that it is possible to reduce the number of parts and hence reduce the size and cost of the apparatus as well as improve the reliability.

In accordance with the thirteenth configuration of the invention, when an image forming apparatus, or the computer or word processor which transfers the image data to the image forming apparatus has no image data restructuring means of the invention, the program required for restructuring the image data may be transferred from the recording media such as floppy discs and MO discs into the computer or word processor. Therefore, it is possible for such an image forming apparatus which has no image data restructuring means to achieve satisfactory image formation.

What is claimed is:

1. An image forming apparatus at least comprising:

a supplying means having a developer support carrying a developer;

an opposing electrode disposed facing the developer support;

a high-voltage power source for supplying a high voltage to produce a potential difference between the developer support and the opposing electrode;

a control electrode at least comprising:

an insulative substrate disposed between the developer support and the opposing electrode;

a plurality of gates formed in the insulative substrate for forming a passage of the developer;

one or more electrode groups provided covering a multiple number of the gates; and a control means for applying multiple potential states to each electrode group of the control electrode, wherein the control means controls the passage of the developer through the multiple number of the gates by applying a designated voltage to the electrode groups so as to form an image on a surface of a recording medium which is being conveyed over the opposing electrode, characterized in that, when a value as to a certain image-quality indicator for a first image, which is an ideal image to be formed on the recording medium surface, differs from a value as to an image-quality indicator for a second image, which is a predicted image to be formed on the recording medium surface, beyond a predetermined range, the control means restructures image data so that a desired image is obtained, wherein the image forming apparatus further includes a memory and the ideal image and the predicted image are formed in the memory using the image data, the ideal image being formed when the developer passes through the multiple number of the gates in an ideal manner and the predicted image being formed when the developer passes through the multiple number of the gates in a predicted manner, wherein the control means, at least, performs control of an arbitrary gate of the multiple number of the gates so as to cause the developer to transfer toner through the arbitrary gate in three different ways: a first type transfer in which the passage of the developer through the arbitrary gate will not be affected by a previous passage of the developer through the arbitrary gate; a second type transfer which occurs after the developer transfer of the first type and in which the passage of the developer is affected by the first type transfer; and a third type transfer which occurs after the developer transfer of the first and the second types and in which the passage of the developer is affected by the second type transfer, and the control means further comprises an image processing means for restructuring the image data so that the desired image can be formed, by taking advantage of at least one of a plurality of characteristics of the first, the second and the third transfer types, and wherein the image processing means restructures the image data by at least complementing or thinning pixels of data which will be of a dot formed of toner transfer of the second or the third type.

2. The image forming apparatus according to claim 1, wherein the control means comprises an image processing means which, when pixels formed by arbitrary gates of the multiple number of the gates are predicted to cause ununiformity, restructures the image data to be used for printing so that the desired image can be obtained.

3. The image forming apparatus according to claim 2, wherein the image processing means calculates, at least, a value of an image-quality indicator belonging to the image data, a value of an image-quality indicator belonging to an image to be printed, from the image data obtained after the image processing and a difference between the image-quality indicator value belonging to the image data and the image-quality indicator value belonging to the image to be printed, and the image data is repeatedly restructured so that the difference falls within the predetermined range.

4. The image forming apparatus according to claim 2, wherein the image processing means, at least, performs complementation, thinning, position-shifting of pixels, or modification of dot size and dot density by shifting positions of pixels to be formed, or combinations of these, in order to restructure the image data.

5. The image forming apparatus according to claim 1, wherein the image processing means restructures the image data by at least complementing or thinning pixels of data which will be of a dot formed of toner transfer of the first type.

6. The image forming apparatus according to claim 1, wherein the image processing means restructures the image data by at least shifting positions of pixels of data.

7. The image forming apparatus according to claim 1, wherein the image processing means restructures the image data by at least changing a number of pixels which will be of a dot of the first transfer type, and a number of pixels which will be of a dot of the second or the third transfer type.

8. The image forming apparatus according to claim 1, wherein the image processing means achieves data restructuring by at least, dividing the image data into multiple areas to extract a characteristic value from each area and determining contents of restructuring the image data based on the extracted characteristic values.

9. The image forming apparatus according to claim 1, wherein a plurality of supplying means each having a different color of developer are provided to form color images and the control means restructures the image data for each color of developer, separately.

10. The image forming apparatus according to claim 2, wherein the image processing means is installed in a separate appliance which is connected to the image forming apparatus.

11. A recording medium for storing an image forming control program for controlling an image forming apparatus which at least comprises:

a supplying means having a developer support carrying the developer;

an opposing electrode disposed facing the developer support;

a high-voltage power source for supplying a high voltage to produce a potential difference between the developer support and the opposing electrode;

a control electrode at least comprising:

an insulative substrate disposed between the developer support and the opposing electrode;

a plurality of gates formed in the insulative substrate for forming a passage of the developer;

one or more electrode groups provided covering a multiple number of the gates; and a control means for applying multiple potential states to each electrode group of the control electrode, so that the control means applies voltages to the electrode groups to control the passage of the developer through the gates to thereby form an image on a surface of a recording medium being conveyed over the opposing electrode, characterized in that an image forming control program is stored therein which instructs the control means to restructure the image data so that the desired image can be obtained, when a value as to a certain image-quality indicator for the first image, which is an ideal image to be formed on the recording medium surface, differs from a value as to the image-quality indicator for the second image, which is a predicated, actually formed image on the recording medium surface, by a predetermined amount, wherein the image forming apparatus further includes a memory and the ideal image and the predicted image are formed in the memory using the image data, the ideal image being formed when the developer passes through the multiple number of the gates in an ideal manner and the predicted image being formed when the developer passes through the multiple number of the gates in a predicted manner, wherein the image forming control program further instructs the control means, at least, to perform control of an arbitrary gate of the multiple number of the gates so as to cause the developer to transfer toner through the arbitrary gate in three different ways: a first type transfer in which the passage of the developer through the arbitrary gate will not be affected by a previous passage of the developer through the arbitrary gate; a second type transfer which occurs after the developer transfer of the first type and in which the passage of the developer is affected by the first type transfer;

and a third type transfer which occurs after the developer transfer of the first and the second types and in which the passage of the developer is affected by the second type transfer, and the control means further comprises an image processing means for restructuring the image data so that the desired image can be formed, by taking advantage of at least one of a plurality of characteristics of the first, the second and the third transfer types, and wherein the image processing means restructures the image data by at least complementing or thinning pixels of data which will be of a dot formed of toner transfer of the second or the third type.

* * * * *